US008695963B2

(12) United States Patent
Taniguchi

(10) Patent No.: US 8,695,963 B2
(45) Date of Patent: Apr. 15, 2014

(54) FEEDING DEVICE AND RECORDING APPARATUS

(75) Inventor: Hisashi Taniguchi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/954,594

(22) Filed: Nov. 24, 2010

(65) Prior Publication Data

US 2011/0068534 A1 Mar. 24, 2011

Related U.S. Application Data

(63) Continuation of application No. 12/178,332, filed on Jul. 23, 2008, now Pat. No. 7,862,032.

(30) Foreign Application Priority Data

Aug. 10, 2007 (JP) ..... 2007-209183

(51) Int. Cl.
*B65H 7/08* (2006.01)

(52) U.S. Cl.
USPC ... 271/110; 271/114; 271/10.03; 271/258.03; 271/265.01

(58) Field of Classification Search
USPC ..... 271/258.03, 10.03, 114, 110, 10.01, 271/266, 265.01
See application file for complete search history.

(56) References Cited

U.S. PATENT DOCUMENTS

| | | | | |
|---|---|---|---|---|
| 4,925,177 | A * | 5/1990 | Nakamura et al. | 271/110 |
| 5,531,435 | A * | 7/1996 | Momose | 271/258.03 |
| 6,135,439 | A * | 10/2000 | Ikeda | 271/10.03 |
| 6,257,569 | B1 * | 7/2001 | Rhodes et al. | 271/117 |
| 7,458,571 | B2 * | 12/2008 | Ogawa | 271/118 |

FOREIGN PATENT DOCUMENTS

| | | | |
|---|---|---|---|
| JP | 2000-264458 | A | 9/2000 |
| JP | 2002-128323 | A | 5/2002 |
| JP | 2007-022738 | A | 2/2007 |

* cited by examiner

*Primary Examiner* — Luis A Gonzalez
(74) *Attorney, Agent, or Firm* — Canon USA, Inc., IP Division

(57) ABSTRACT

A feeding device includes a feeding unit configured to be driven while being in contact with a recording sheet to feed the recording sheet, and a stacking unit configured to stack a plurality of the recording sheets and to press or release the stacked recording sheets to or from the feeding unit. Also, the feeding device includes a separating unit configured to separate the plurality of recording sheets fed by the feeding unit, one by one, a detecting unit configured to detect the recording sheet in an area downstream of the separating unit, and a control unit configured to control each of the units. The control unit switches a feeding operation between at least two feeding operations in accordance with a drive time of the feeding unit from when the feeding unit is started to be driven to when the detecting unit detects the recording sheet.

20 Claims, 20 Drawing Sheets

| |
|---|
| FIG. 12A |
| FIG. 12B |

FEEDING DEVICE AND RECORDING APPARATUS

CROSS REFERENCE TO RELATED APPLICATIONS

The present application is a continuation of U.S. patent application Ser. No. 12/178,332, filed on Jul. 23, 2008, entitled "FEEDING DEVICE AND RECORDING APPARATUS", the content of which is expressly incorporated by reference herein in its entirety. This application also claims priority from Japanese Patent Application No. 2007-209183 filed Aug. 10, 2007, which is hereby incorporated by reference herein in its entirety.

BACKGROUND OF THE INVENTION

1. Field of the Invention

The present invention relates to a feeding device that extracts a recording sheet from a plurality of stacked recording sheets and conveys the extracted sheet, and a recording apparatus including the feeding device.

2. Description of the Related Art

A feeding device is provided in a recording apparatus such as a copier, a printer, or a facsimile, to feed a recording sheet or the like. The feeding device separates a plurality of stacked recording sheets one by one with a feeding roller and a separating mechanism, and conveys the recording sheet to a downstream side. In many cases, a stacking portion in which the recording sheets are stacked is provided with a pressure plate that presses the stacked recording sheets to the feeding roller.

A sheet detecting portion that detects presence of a recording sheet is provided downstream of the feeding roller. After a feeding operation is started, the presence of the recording sheet is checked, so as to check whether a recording sheet is stacked on the feeding device or not, and whether the feeding operation is successfully performed or not. If the sheet detecting portion does not detect a recording sheet within a predetermined time from the start of the feeding operation, the feeding operation is performed again at a speed, which is equivalent to or slower than a feeding speed of the first feeding operation. Such an operation is generally called retry feeding.

If, for example, paper dust adheres on the feeding roller and a friction coefficient is reduced, a slip may occur between the feeding roller and a recording sheet during feeding. The recording sheet may not be extracted from the stacking portion by the first feeding operation. Even when the recording sheet could be extracted from the stacking portion, the recording sheet may not be conveyed to the sheet detecting portion. Also, when the number of recording sheets stacked in the stacking portion is small, the pressure plate may be bounded during pressing, and hence, the conveying force of the feeding roller is not sufficiently provided. In this case, similarly to the situation with a slip, the recording sheet may not be extracted from the stacking portion by the first feeding operation, or the recording sheet may not be conveyed to the sheet detecting portion. Then, the retry feeding is performed, so that the recording sheet is conveyed to a recording portion.

Even when the recording sheet is conveyed to the sheet detecting portion, if sheet detection is delayed, normal feeding of the recording sheet to the recording portion may not performed. Therefore, a relief operation is performed for complementing the feeding, so as to convey the recording sheet to the recording portion.

With the feeding device of the related art, damage, such as a scratch or a wrinkle, may be applied to the recording sheet as a result of a slip between the feeding roller and the recording sheet when the retry feeding or the relief operation is performed. In addition, a time necessary for the retry feeding or the relief operation is seriously longer than a time necessary for the normal feeding operation. Hence, a recording time containing the feeding time may be markedly increased.

Also, a feeding device is provided, in which a feeding roller is coupled with a cam mechanism, and a drive rotation amount of the feeding roller for a single feeding operation is constant. In such a device, a feed and the numbers of normal rotations and reverse rotations may be increased when normal rotation feeding and reverse rotation feeding of a recording sheet are performed to align the recording sheet with a recording-start position. Hence, damage, such as a scratch or a wrinkle, may be applied to the recording sheet, or a recording time containing a feeding time may be markedly increased as a result of the retry feeding or the relief operation. In particular, when a recording sheet with a glossy surface for an enhancement of color developability is used, for example, a slip mark likely remains on the surface and the slip mark may affect image formation.

SUMMARY OF THE INVENTION

Accordingly, the present invention provides a feeding device and a recording apparatus that does not cause an increase in cost or a decrease in throughput, and prevent damage from being applied to a recording sheet during an operation of, for example, retry feeding.

A feeding device according to an aspect of the present invention includes a feeding unit configured to be driven while being in contact with a recording sheet to feed the recording sheet; a stacking unit configured to stack a plurality of the recording sheets and to press or release the stacked recording sheets to or from the feeding unit; a separating unit configured to separate the plurality of recording sheets fed by the feeding unit, one by one; a detecting unit configured to detect the recording sheet in an area located downstream of the separating unit in a feeding direction of the recording sheet; and a control unit configured to control each of the units. The control unit switches a feeding operation between at least two feeding operations in accordance with a drive time of the feeding unit from when the feeding unit is started to be driven to when the detecting unit detects the recording sheet, the at least two feeding operations including a first feeding operation in which the recording sheet is pressed to the feeding unit to be fed while the feeding unit is being driven, and a second feeding operation in which the driving of the feeding unit is stopped, then the recording sheet is pressed to the feeding unit, and then the feeding unit is driven again.

Further features and aspects of the present invention will become apparent from the following description of exemplary embodiments with reference to the attached drawings.

DESCRIPTION OF THE EMBODIMENTS

Figure 1A:
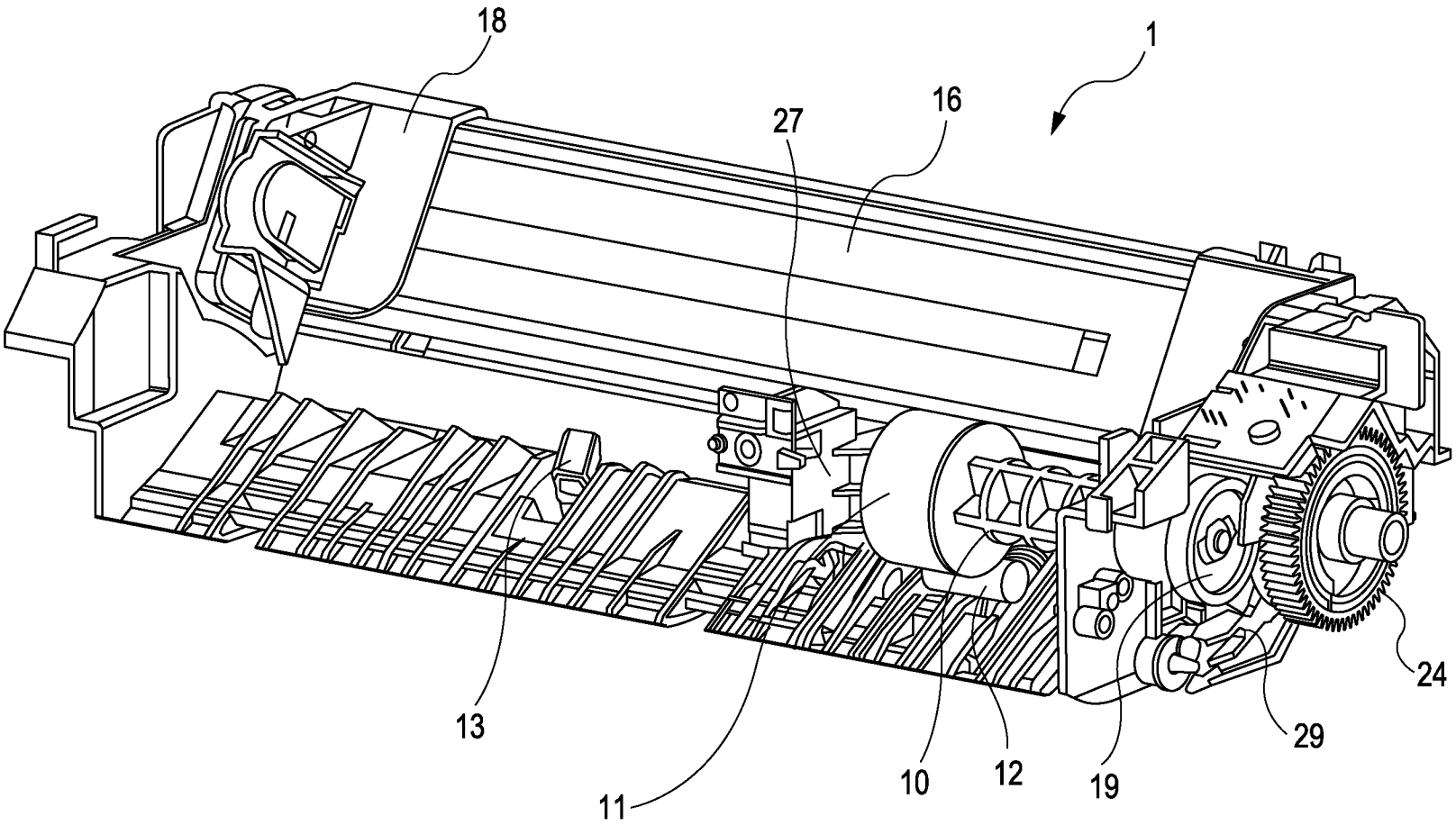
FIG. 1A is a schematic perspective view showing an example feeding device.

Embodiments of the present invention will be described below in detail with reference to the attached drawings. In the drawings, like numerals refer like or corresponding components.

First Exemplary Embodiment

Figure 1B:
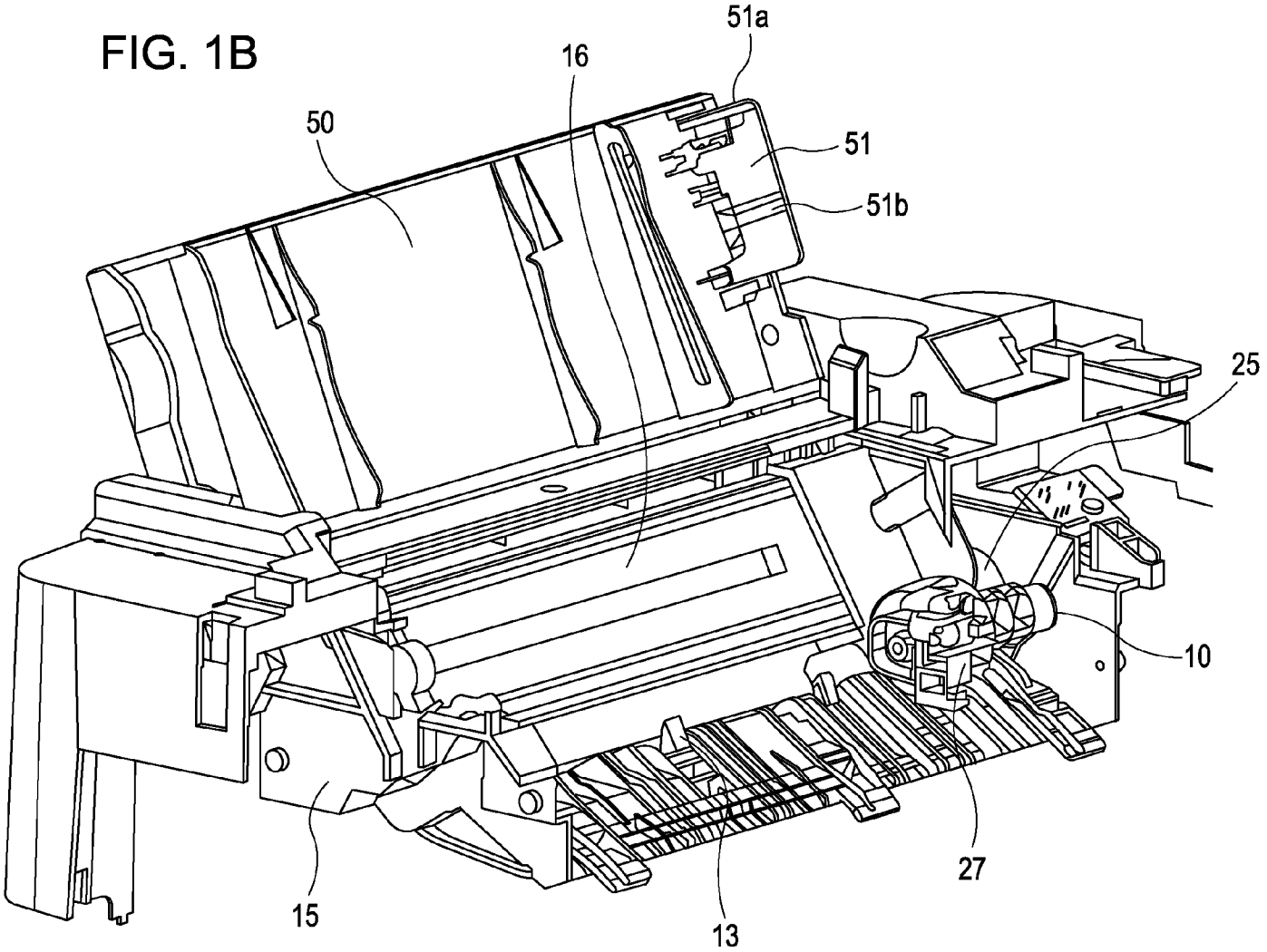
FIG. 1B is a schematic perspective view showing the feeding device.
Figure 2:
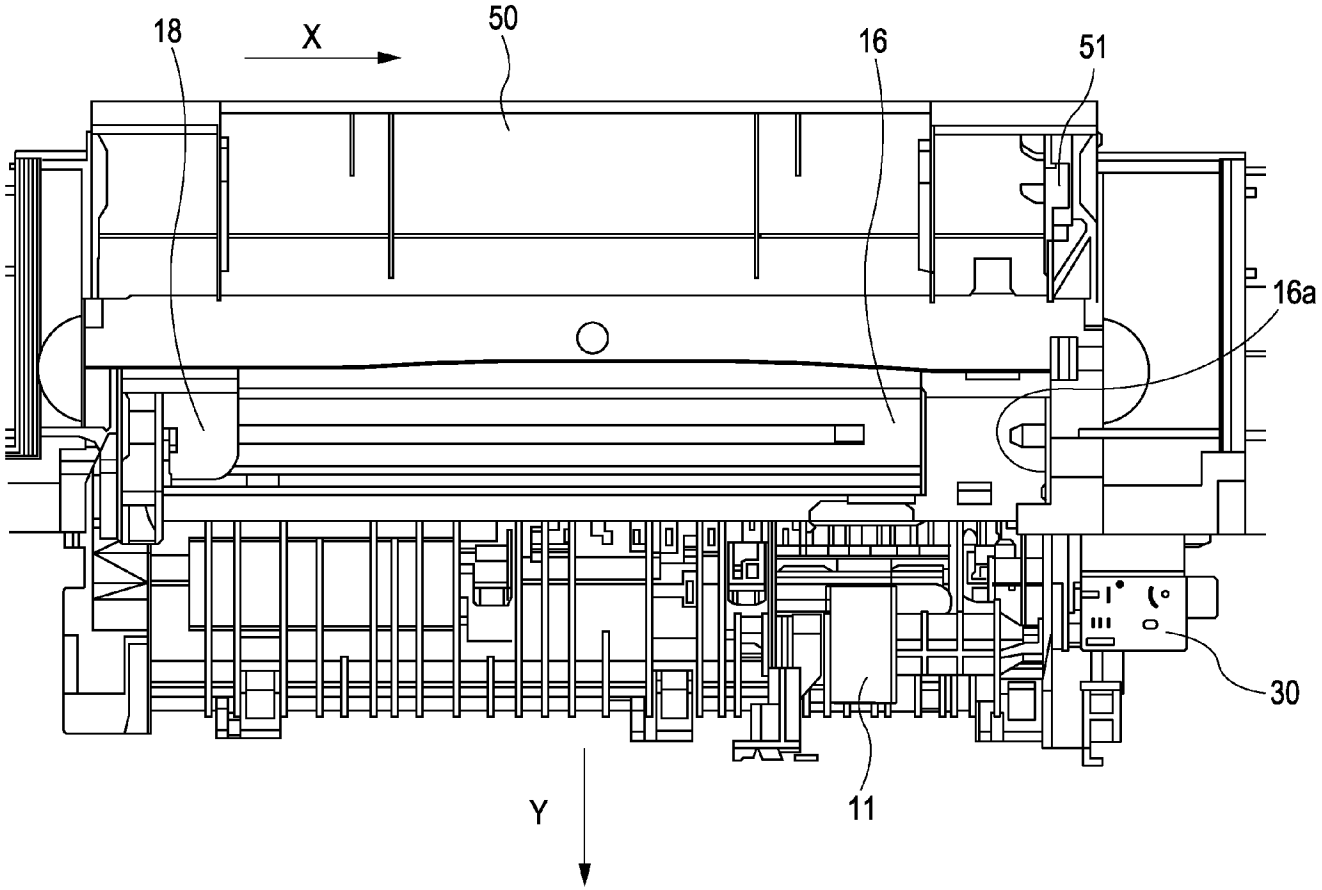
FIG. 2 is a top view showing the feeding device.
Figure 3:
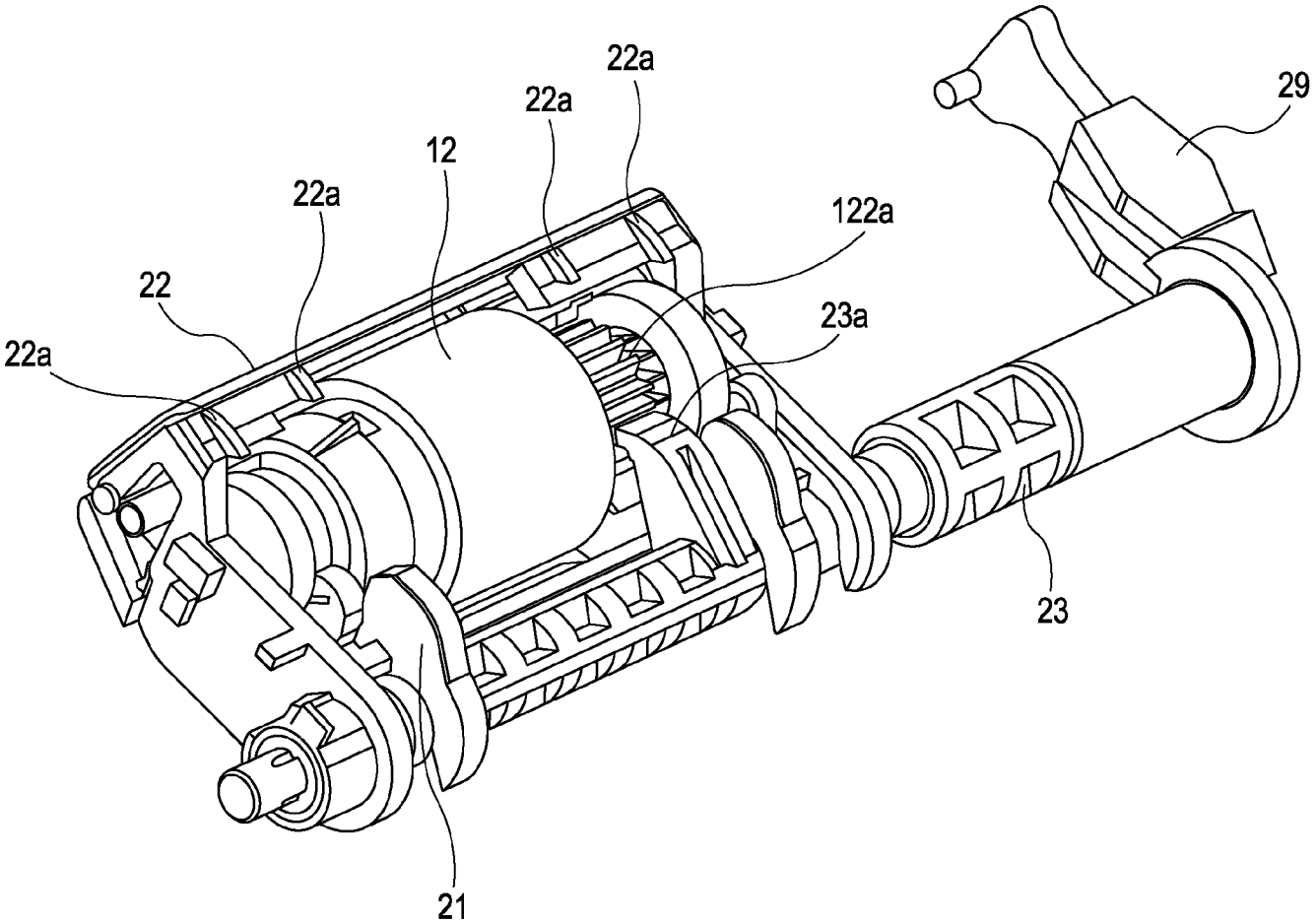
FIG. 3 is a schematic perspective view showing a separating portion.
Figure 4:
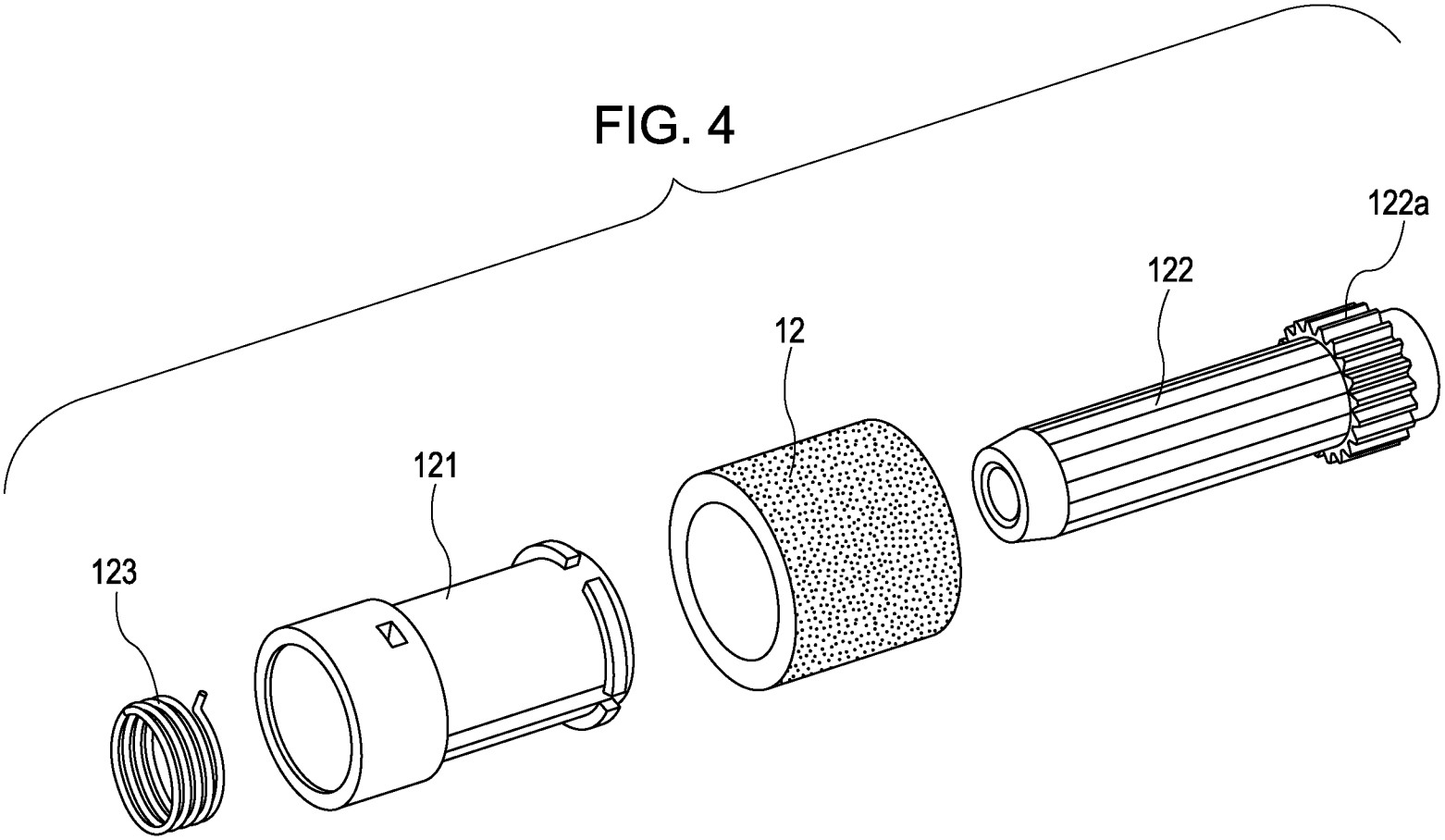
FIG. 4 is an exploded perspective view showing a separating roller.
Figure 5B:
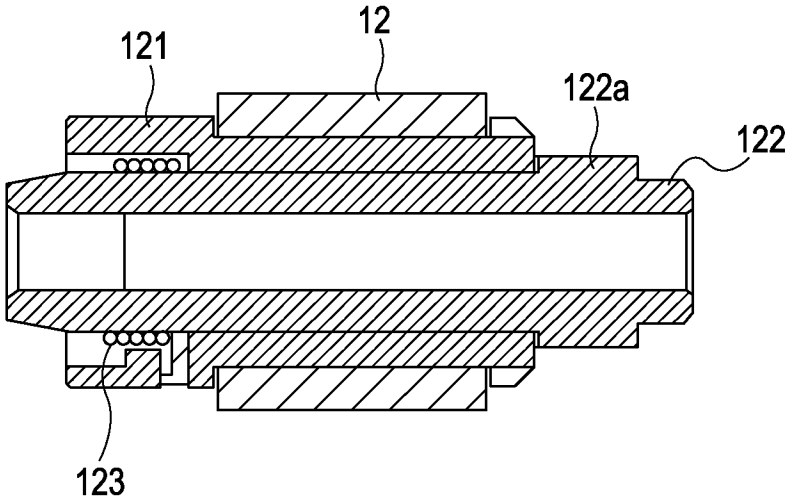
FIG. 5B is a horizontal cross section showing the separating roller taken along line VB-VB in FIG. 5A.
Figure 5A:
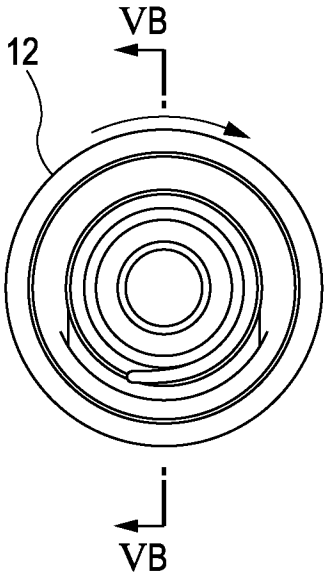
FIG. 5A is a front view of the separating roller.
Figure 6A:
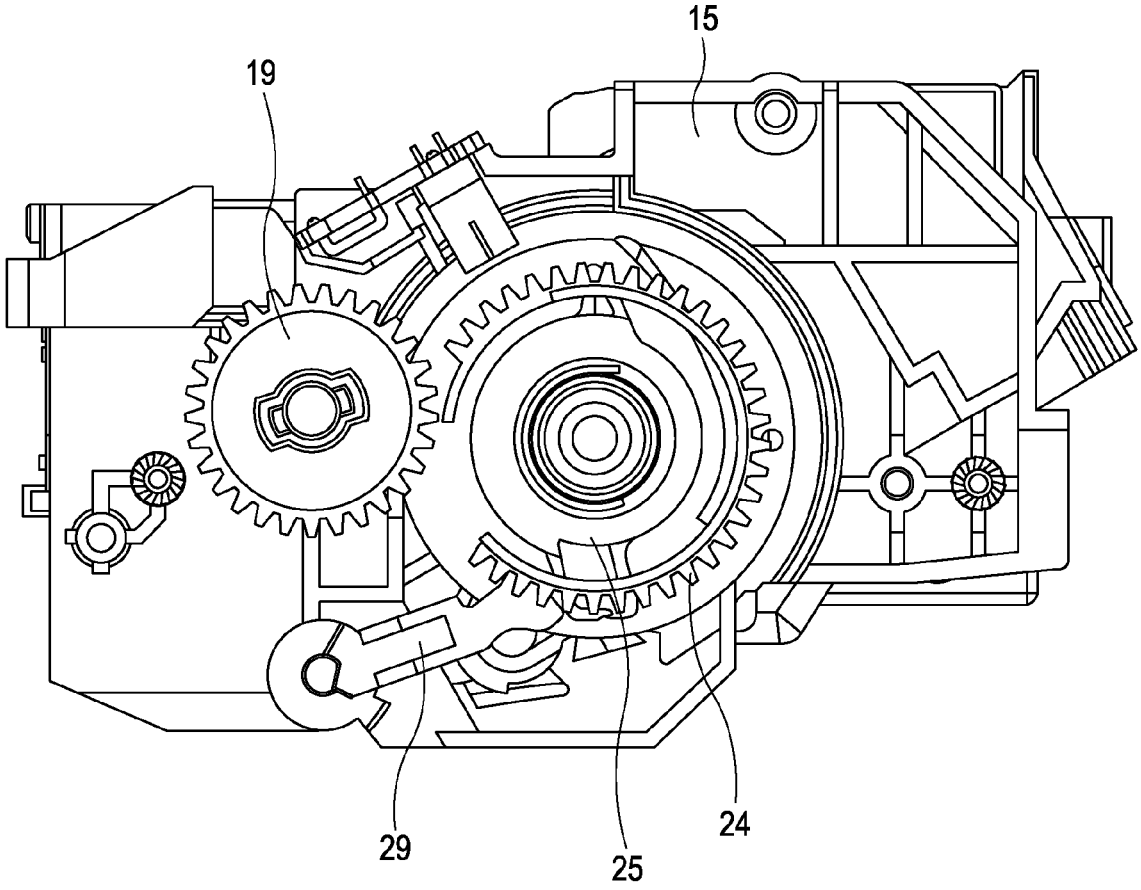
FIG. 6A is a side cross section partially showing a drive transmission configuration of the feeding device.
Figure 6B:
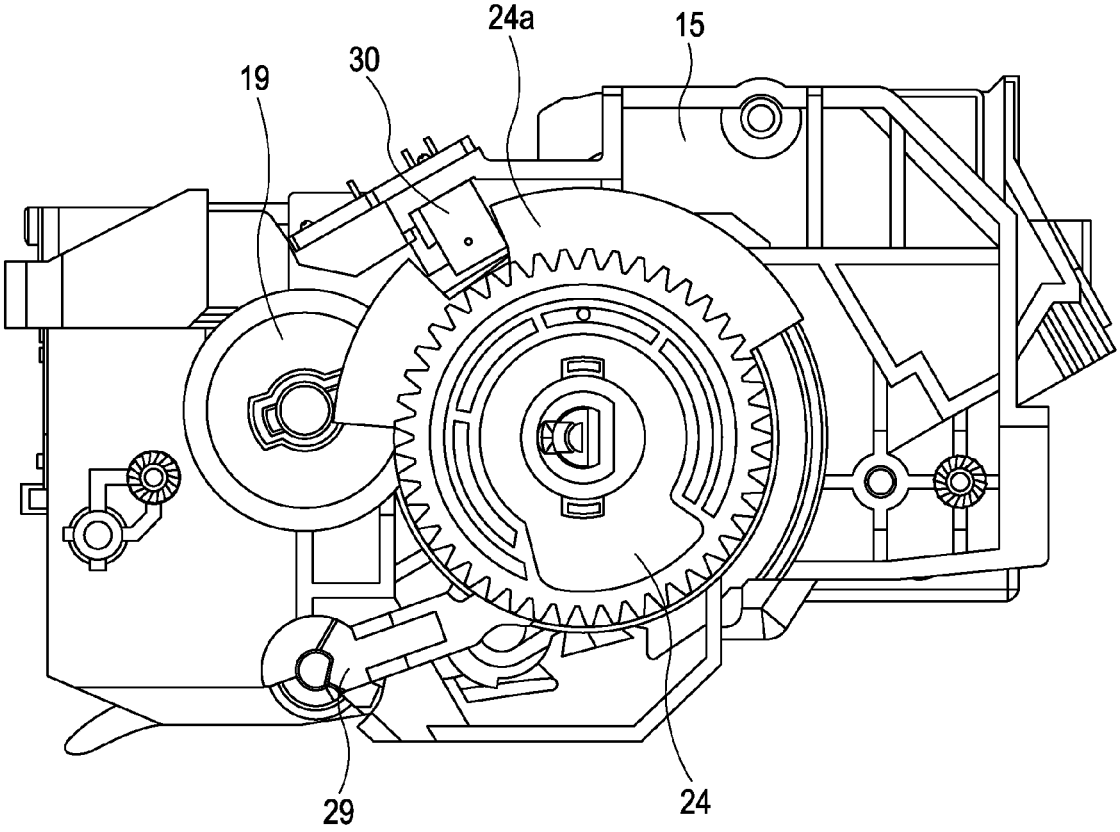
FIG. 6B is a side cross section partially showing the drive transmission configuration of the feeding device.
Figure 8:
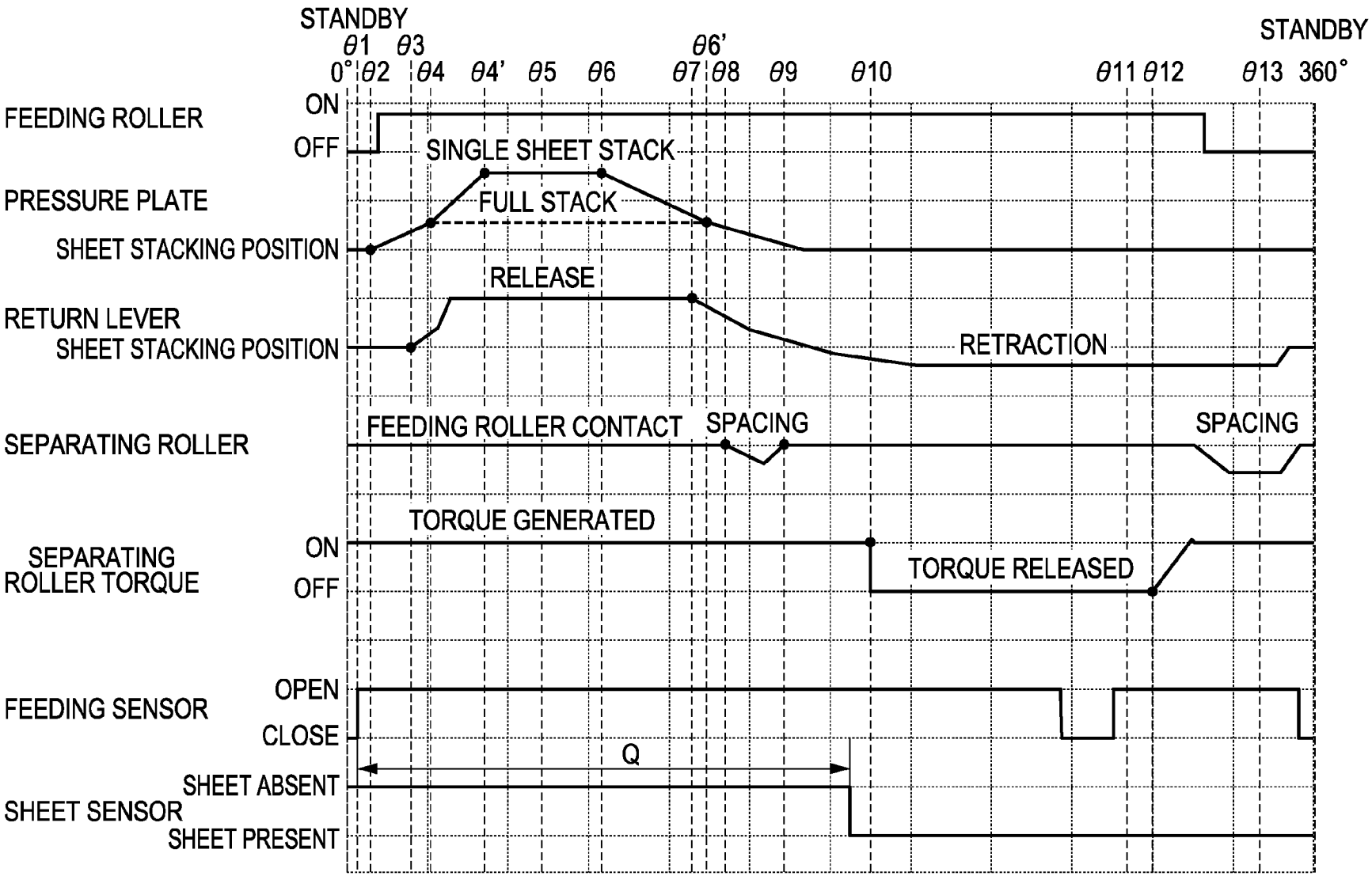
FIG. 8 is a timing chart showing the operation of the feeding device.
Figure 9A:
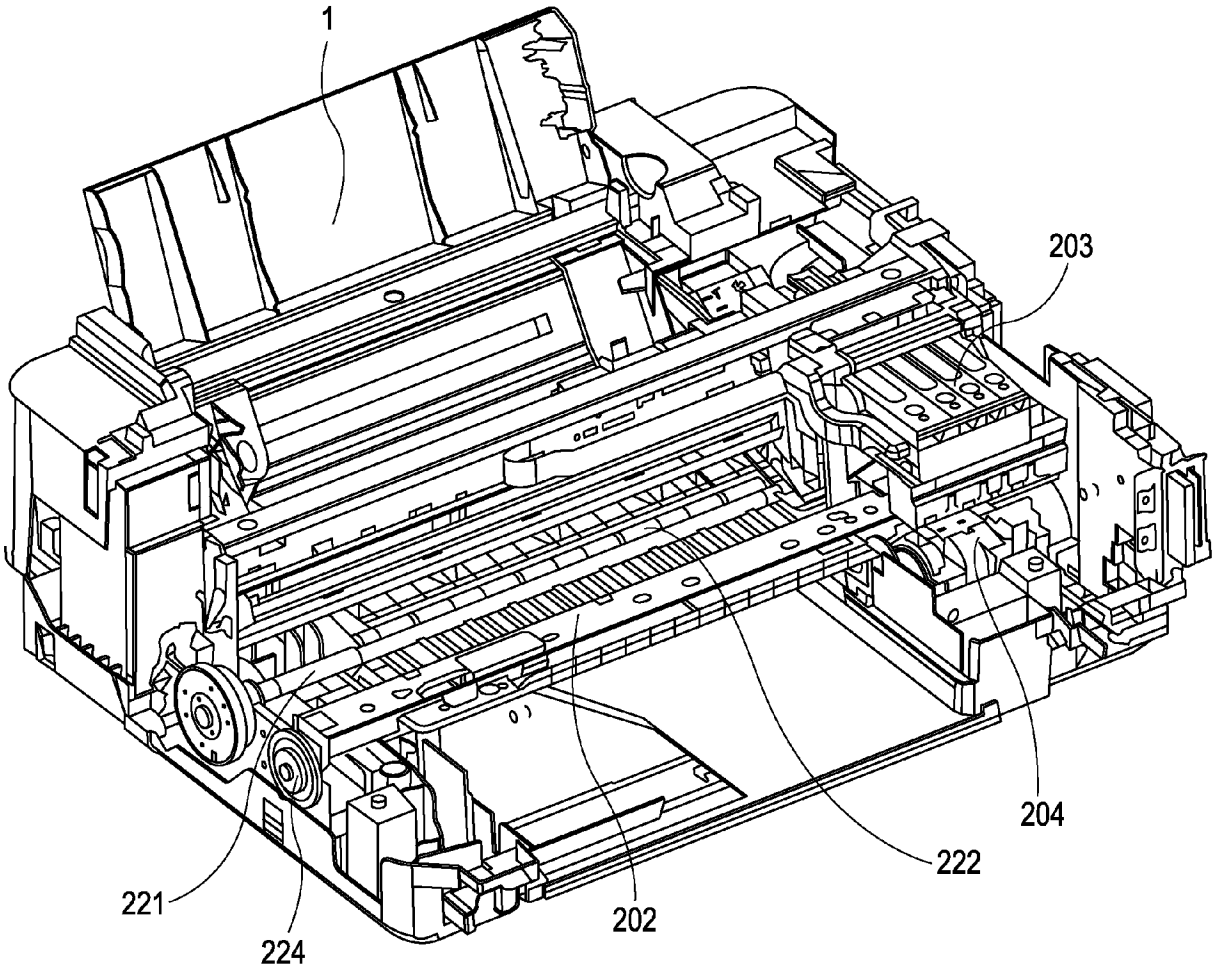
FIG. 9A is a schematic perspective view briefly showing a recording apparatus.
Figure 9B:
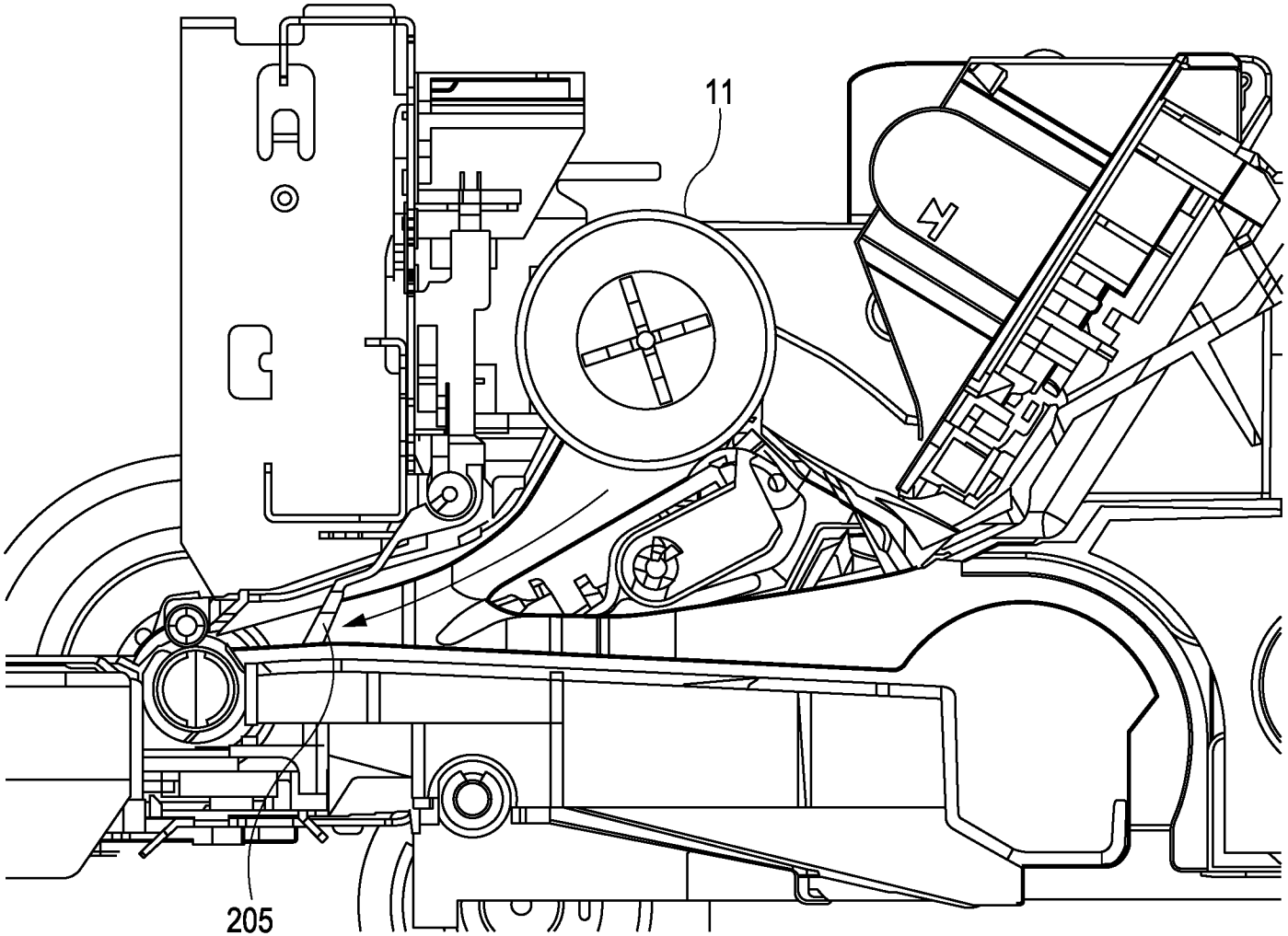
FIG. 9B is a schematic side view briefly showing the recording apparatus.
Figure 10:
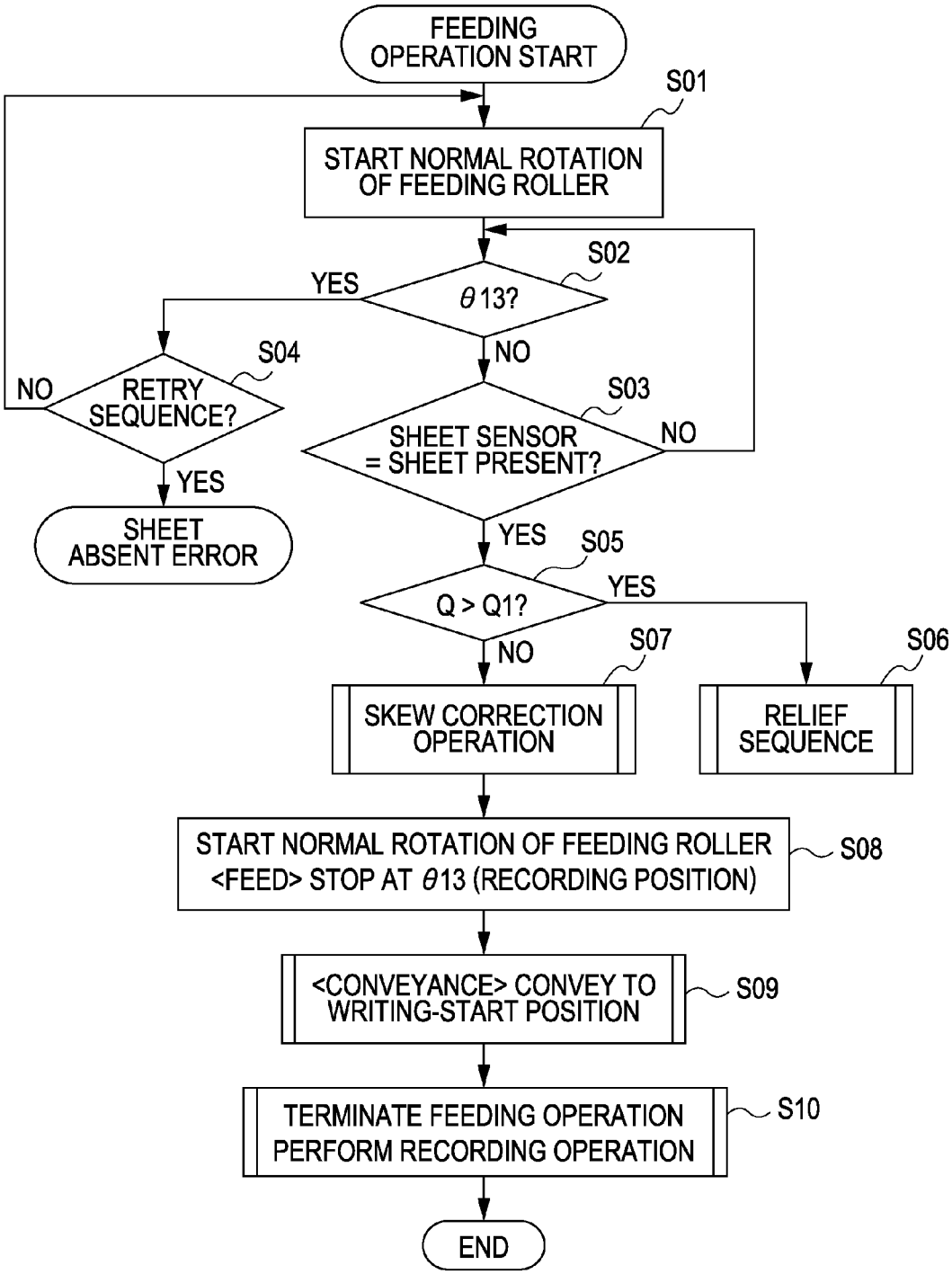
FIG. 10 is a flowchart showing an example single-sheet feeding operation of the feeding device.
Figure 11:
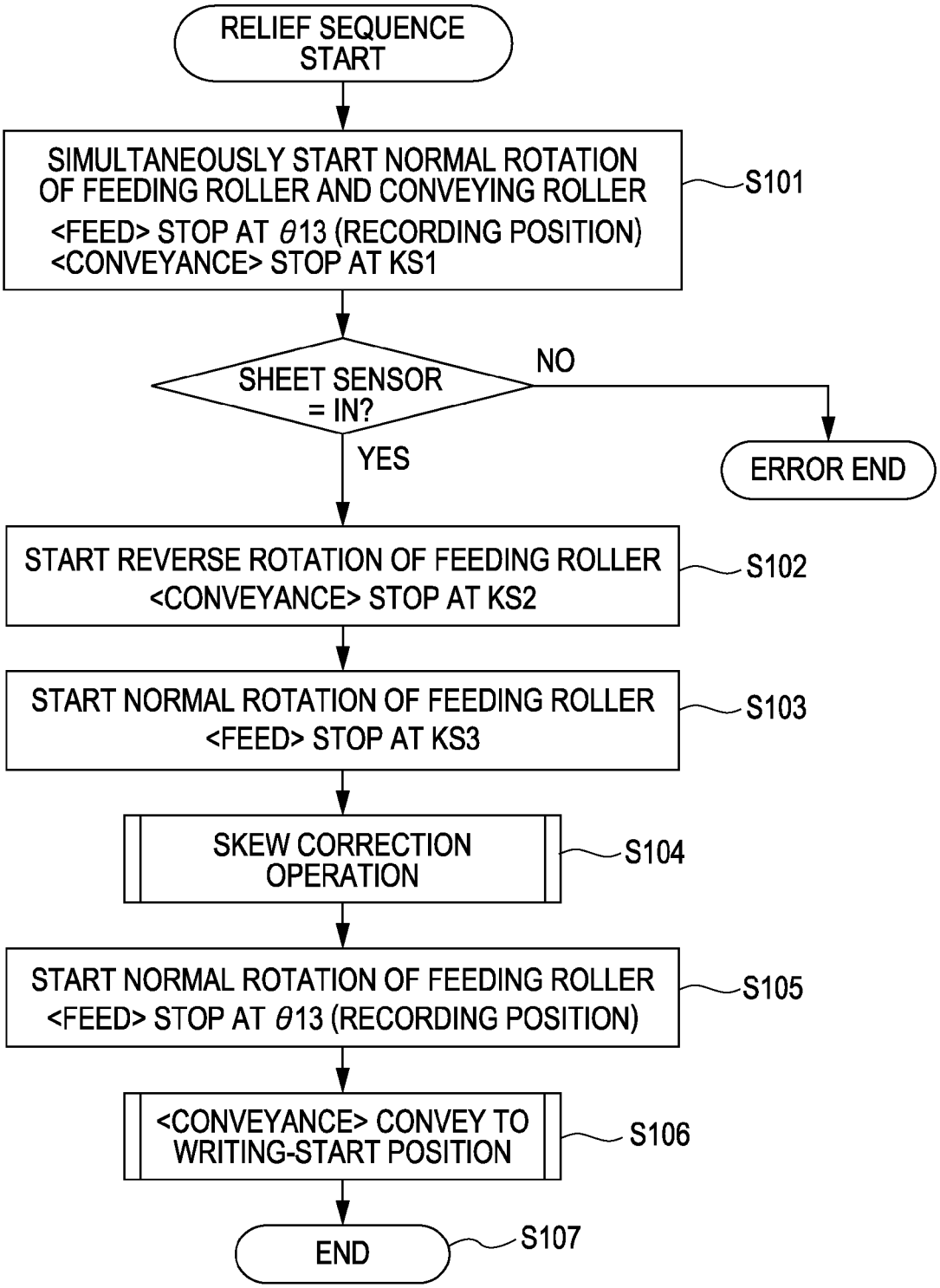
FIG. 11 is a flowchart showing an example relief sequence of the feeding device.
Figures 12, 12A:
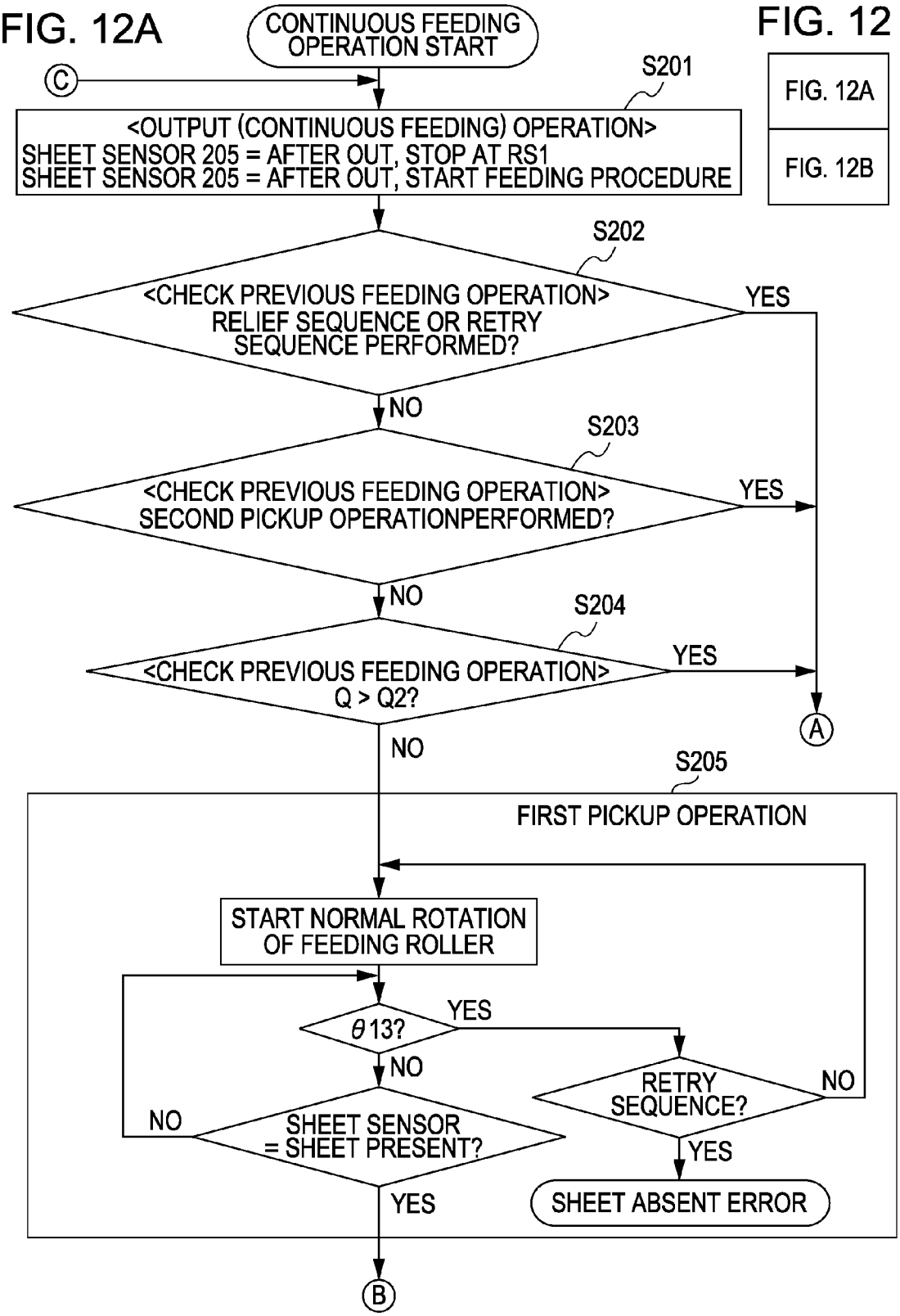
FIGS. 12A and 12B show a flowchart of an example continuous feeding operation of the feeding device.

FIGS. 1A and 1B are schematic perspective views briefly showing a feeding device according to this embodiment. FIG. 2 is a top view showing the feeding device. FIG. 3 is a schematic perspective view briefly showing a separating portion provided in the feeding device. FIG. 4 is an exploded perspective view showing a separating roller. FIGS. 5A and 5B are a front view and a horizontal cross section of the separating roller. FIGS. 6A and 6B are side cross sections partially showing a drive transmission mechanism of the feeding device. FIGS. 7A to 7E are side cross sections showing an operation of the feeding device. FIG. 8 is a timing chart showing an operation of the feeding device. FIG. 9A is a schematic perspective view showing an inkjet recording apparatus to which the feeding device according to this embodiment is applied. FIG. 9B is a side cross section of the inkjet recording apparatus. FIGS. 10 to 12 are flowcharts showing operations of the feeding device. For the convenience of description, the inkjet recording apparatus shown in FIGS. 9A and 9B is described first.

[Example Configuration of Recording Apparatus]

As shown in FIGS. 9A and 9B, the inkjet recording apparatus includes a feeding device 1 according to this embodiment, and a conveying portion 202 that conveys a recording sheet as a recording material through a recording apparatus body (recording portion and the like). The inkjet recording apparatus also includes a recording mechanism (carriage unit 203) that records an image (which contains a character, a symbol, and the like) on a recording sheet in accordance with input recording data, and a cleaning mechanism (recovery mechanism 204) for keeping the quality of an image formed with the carriage unit 203.

Recording sheets stacked in the feeding device 1 are separated one by one and fed to the conveying portion 202. A PE sensor 205 is provided between the feeding device 1 and the conveying portion 202. The PE sensor 205 detects a recording sheet fed from the feeding device 1.

The recording sheet fed to the conveying portion 202 is conveyed with a friction conveying force between a conveying roller 221 that is driven with a conveyance motor, and a pinch roller 222 that is pressed to the conveying roller 221. The recording sheet is then conveyed in the recording portion pitch by pitch. The carriage unit 203 records an image on a surface of the recording sheet conveyed pitch by pitch as described above.

The recording sheet after recording is output to the outside of the recording apparatus body with a conveying force caused by an output roller (not shown) that is driven in association with the conveying roller 221, and a driven roller that is driven in conjunction with the output roller.

The carriage unit 203 includes a carriage that is guided and supported movably in a main-scanning direction in a reciprocating manner within the recording apparatus body, a recording cartridge serving as a recording unit, and other components. The carriage with the recording cartridge mounted is guided and supported movably in a reciprocating manner along a guide rail provided in the recording apparatus body. The carriage receives a driving force of a carriage motor via a carriage belt 224. The carriage is moved in a reciprocating manner along the guide rail with the driving force of the carriage motor. At this time, an encoder sensor mounted on the carriage unit 203 senses a slit provided in an encoder scale, and hence, the position of the carriage unit 203 in the main-scanning direction and the speed thereof are recognized. A recording operation with the recording cartridge, which is performed in synchronization with a reciprocating movement (main-scanning) of the carriage, and a pitch conveyance (sub-scanning) of the recording sheet are repeated, to perform recording on the entire recording sheet.

The recovery mechanism 204, for example, eliminates clogging of an inkjet recording head so as to maintain and recover the recording quality to a good condition. In particular, the recovery mechanism 204 includes a pumping unit configured to suck ink from discharge ports of the recording head, a capping unit configured to cover the discharge ports, and a wiping unit configured to wipe a discharge-port surface.

[Example Configuration of Feeding Device]

The feeding device 1 includes a control portion that generally controls at least a part of each component described below. The control portion of the feeding device may be a control portion of the recording apparatus body, or may be a sub-portion provided in the control portion of the recording apparatus body. The sub-portion controls each component of the feeding device according to an instruction given by the control portion of the recording apparatus body.

Referring to FIGS. 1A and 1B, in the feeding device 1, a plurality of recording sheets 20 (FIG. 7A and other figures) can be stacked on a pressure plate 16 serving as a stacking unit that is rotatably attached to a base 15 (see FIG. 1B). The pressure plate 16 is attached so as to be inclined to a horizontal plane in which the apparatus is installed. The recording sheets 20 set (see FIGS. 7A-E) in the feeding device 1 are stacked in an inclined manner. Hence, the recording sheets 20 are biased downward due to the weight thereof. Front edges of the recording sheets 20 contact a sheet edge reference portion 15*a* (FIG. 7A) fixedly provided at the base 15. Since the recording sheets 20 are stacked in an inclined manner, the installation surface of the feeding device 1 can be reduced, and the size of the entire apparatus can be reduced. In this embodiment, the sheet edge reference portion 15*a* has a rib form to reduce a load during feeding.

Referring to FIG. 2, a sheet conveyance reference portion 16*a* is provided on the pressure plate 16, for regulating one of both side surfaces of the stacked recording sheets 20. Also, a side guide 18 is provided for regulating the other of both side surfaces of the recording sheets 20. The side guide 18 is attached slidably in a direction intersecting with a sheet conveyance direction Y (that is, in a direction indicated by arrow X). The side guide 18 can position both side surfaces of the recording sheets 20, which may have any width within a predetermined range, in cooperation with the sheet conveyance reference portion 16*a*.

A feeding tray 50 defining a stacking unit together with the pressure plate 16 is provided upstream of the pressure plate 16 in the sheet conveyance direction Y. The feeding tray 50 supports a rear portion of recording sheets when the recording sheets are longer than the pressure plate 16 in the sheet conveyance direction Y. The feeding tray 50 is provided with a sub-guide member 51 to regulate a side end portion of the recording sheets which are long in the sheet conveyance direction Y. Referring to FIG. 1B, the sub-guide member 51 has ribs 51*a* and 51*b*, and is arranged such that the rib 51*a* contacts the side end portion of the stacked recording sheets. The rib 51*a* of the sub-guide member 51 has a smaller contact surface to the recording sheets than a contact surface of the sheet conveyance reference portion 16*a* (FIG. 2) to the recording sheets. In addition, the rib 51*a* is retracted in the direction indicated by arrow X in FIG. 2 with respect to the sheet conveyance reference portion 16*a*. Further, the sub-guide member 51 is elastically deformable in the direction indicated by arrow X in FIG. 2.

The pressure plate 16 has a rotation center at an upper end thereof, and is rotatable in a direction toward a feeding roller 11 which is a rotational body serving as a feeding unit, and in a direction away from the feeding roller 11. Also, the pressure plate 16 is biased to the feeding roller 11 with a pressure plate spring 17 (FIG. 7B), and is regulated with a pressure plate cam 25 (FIG. 6A) that is rotationally driven with a control gear 24 (FIG. 6A). That is, when the pressure plate cam 25 releases the regulation with the pressure plate spring 17, the pressure plate 16 is rotated in the direction toward the feeding roller 11 by the pressure plate spring 17 with the regulation thereof released. In contrast, when the pressure plate cam 25 presses the pressure plate 16, the pressure plate 16 is forcibly rotated in the direction away from the feeding roller 11.

Referring to FIG. 1A, the feeding device 1 of this embodiment includes a separating roller 12 serving as a separating unit that contacts the recording sheets 20 stacked on the pressure plate 16 and separates the recording sheets 20 one by one, and a return lever 13 serving as a return unit that pushes and returns the recording sheets 20 to the pressure plate 16. Further, referring to FIG. 3, a plurality of preparatory regulation portions 22*a* are provided near the separating roller 12, to regulate the number of recording sheets 20 that reach the separating portion.

Referring back to FIG. 1A, the recording sheets 20 are pressed to or released from the feeding roller 11 by the pressure plate 16 rotated in the direction toward the feeding roller 11. The feeding roller 11 to which the recording sheets 20 are pressed is rotationally driven in this state. Accordingly, a top recording sheet 20*a* (FIG. 7B and other figures) is fed to a downstream side with a friction force. Since the feeding roller 11 feeds the recording sheet 20 to the downstream side in the feeding direction with the friction force, a material of the feeding roller 11 may be rubber, urethane foam, or the like, having a high friction coefficient, such as ethylene-propylene-diene monomer (EPDM).

The feeding roller 11 is attached to a conveying shaft 10. The conveying shaft 10 is rotatably supported by a bearing portion of the base 15 and a bearing 27 (FIG. 1B), and has a feeding shaft gear 19 (see FIG. 1A) at an end thereof. Referring to FIG. 6A, the feeding shaft gear 19 meshes with the control gear 24. The control gear 24 transmits a driving force input from a drive source (not shown) to the feeding shaft gear 19.

Referring to FIG. 6B, the control gear 24 has a sensor flag 24*a*, so that a feeding sensor 30 can recognize a rotation angle of the control gear 24.

When a plurality of recording sheets 20 enter a nip defined between the feeding roller 11 and the separating roller 12, the separating roller 12 separates and feeds the recording sheets 20 one by one.

Figure 7A:
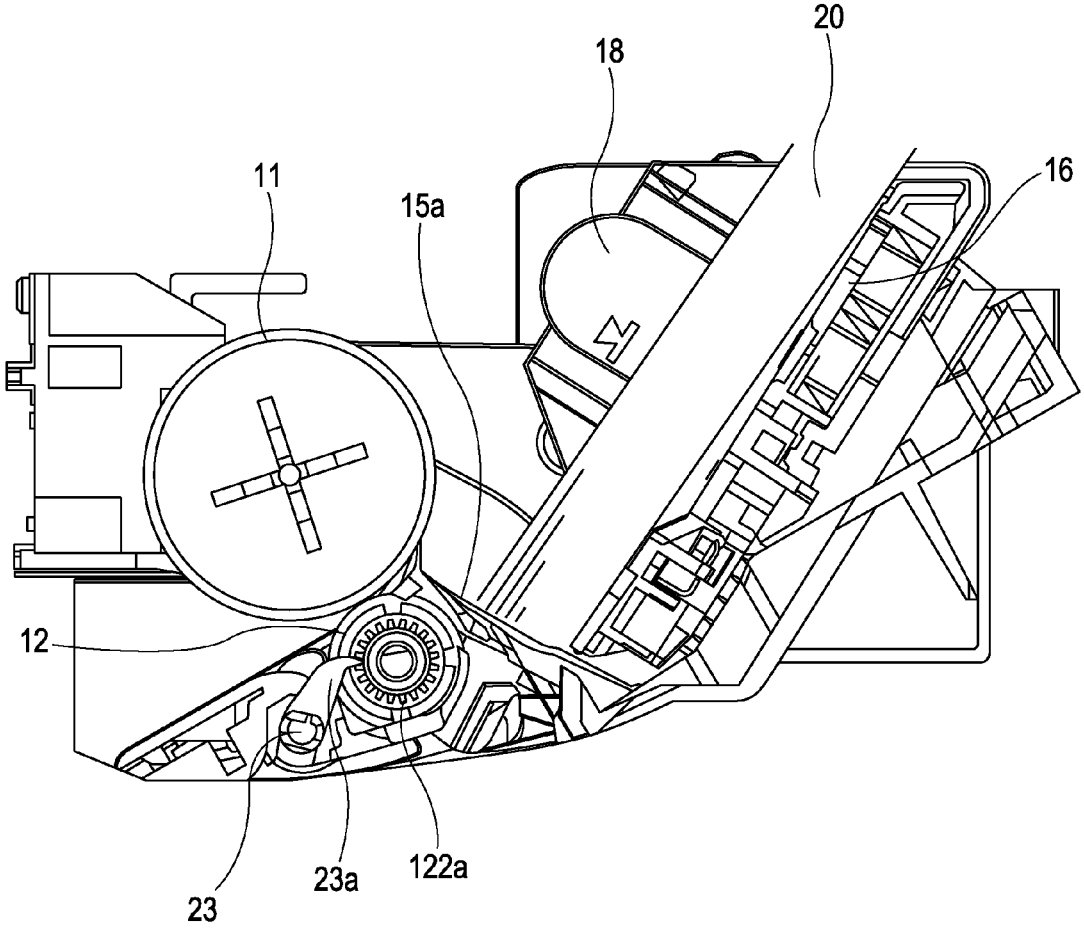
FIG. 7A is a side cross section showing an operation of the feeding device.

Referring to FIG. 7A, the separating roller 12 is pressed to the feeding roller 11 in an area located downstream of a point at which the feeding roller 11 contacts the recording sheet 20 first in the feeding direction. A surface of the separating roller 12 is made of rubber, urethane foam, or the like, to have a friction coefficient similar to that of the feeding roller 11.

Here, an example configuration of the separating roller 12 is described with reference to FIGS. 4, 5A and 5B. Referring to FIG. 4, the separating roller 12 is fixed to a clutch cylinder 121. The clutch cylinder 121 houses a clutch shaft 122 in a rotatable manner. Also, a clutch spring 123 is wound around the clutch shaft 122. A winding end of the clutch spring 123 is engaged with the clutch cylinder 121 (FIG. 5B). In this embodiment, the clutch shaft 122 is made of a molded part. In an end of the clutch shaft 122, a gear portion 122*a* is integrally molded. The clutch spring 123 is made of a metal coil spring.

When the separating roller 12 and the clutch cylinder 121 are rotated in a direction indicated by an arrow in FIG. 5A while the clutch shaft 122 is fixed, the clutch spring 123 wound around the clutch shaft 122 is released from the clutch shaft 122. When the separating roller 12 and the clutch cylinder 121 are rotated by a predetermined angle, the clutch shaft 122 slides relative to the clutch spring 123, and thereby a predetermined torque is maintained.

Referring to FIG. 3, a lock lever 23*a* can be engaged with the gear portion 122*a* of the clutch shaft 122. On-off control of a torque limiter can be executed through fixing and releasing of the clutch shaft 122 with the lock lever 23*a*.

The separating roller 12 is rotatably supported by a separating roller holder 21 via the clutch cylinder 121 and the clutch shaft 122, and pressed to the feeding roller 11 with a separating roller spring (not shown).

Figure 7B:
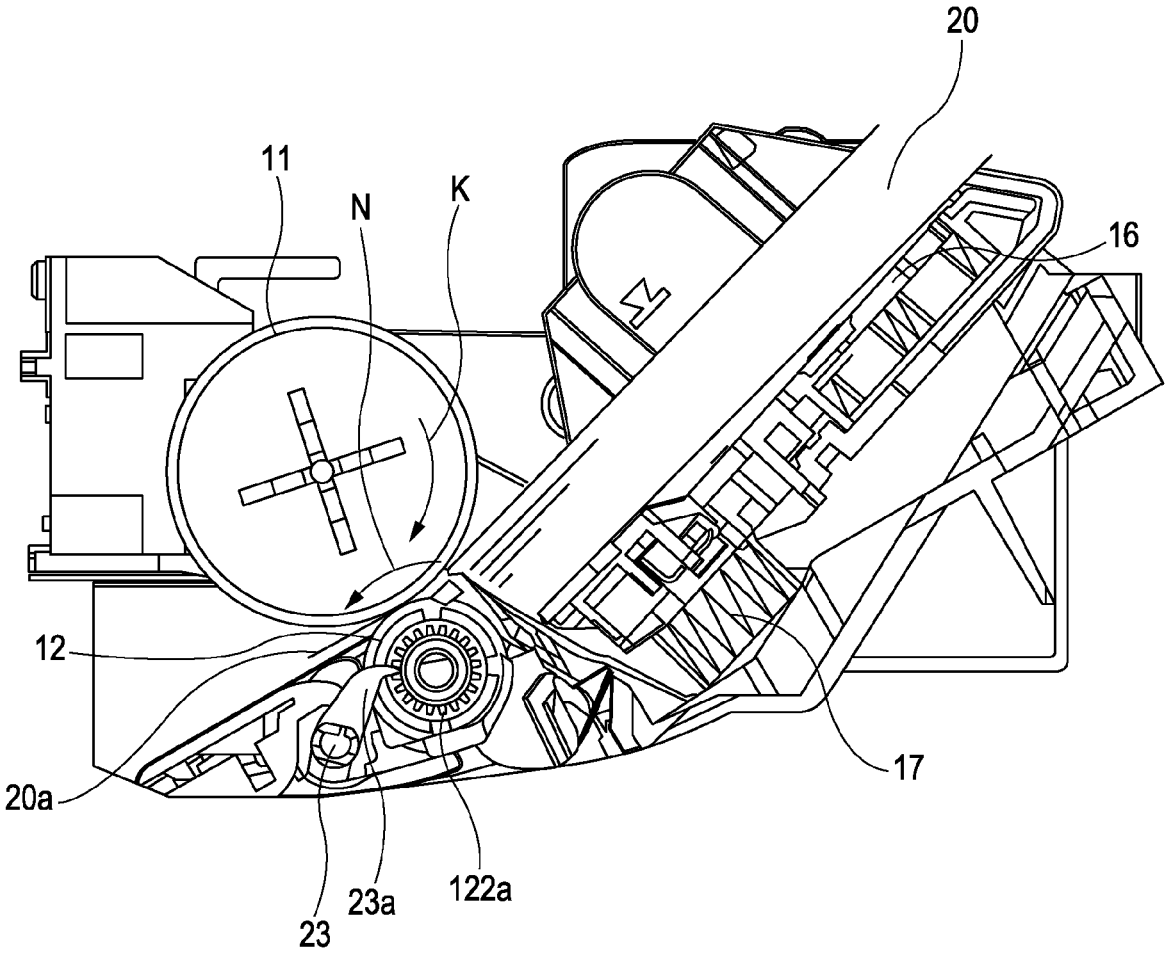
FIG. 7B is a side cross section showing the operation of the feeding device.
Figure 7C:
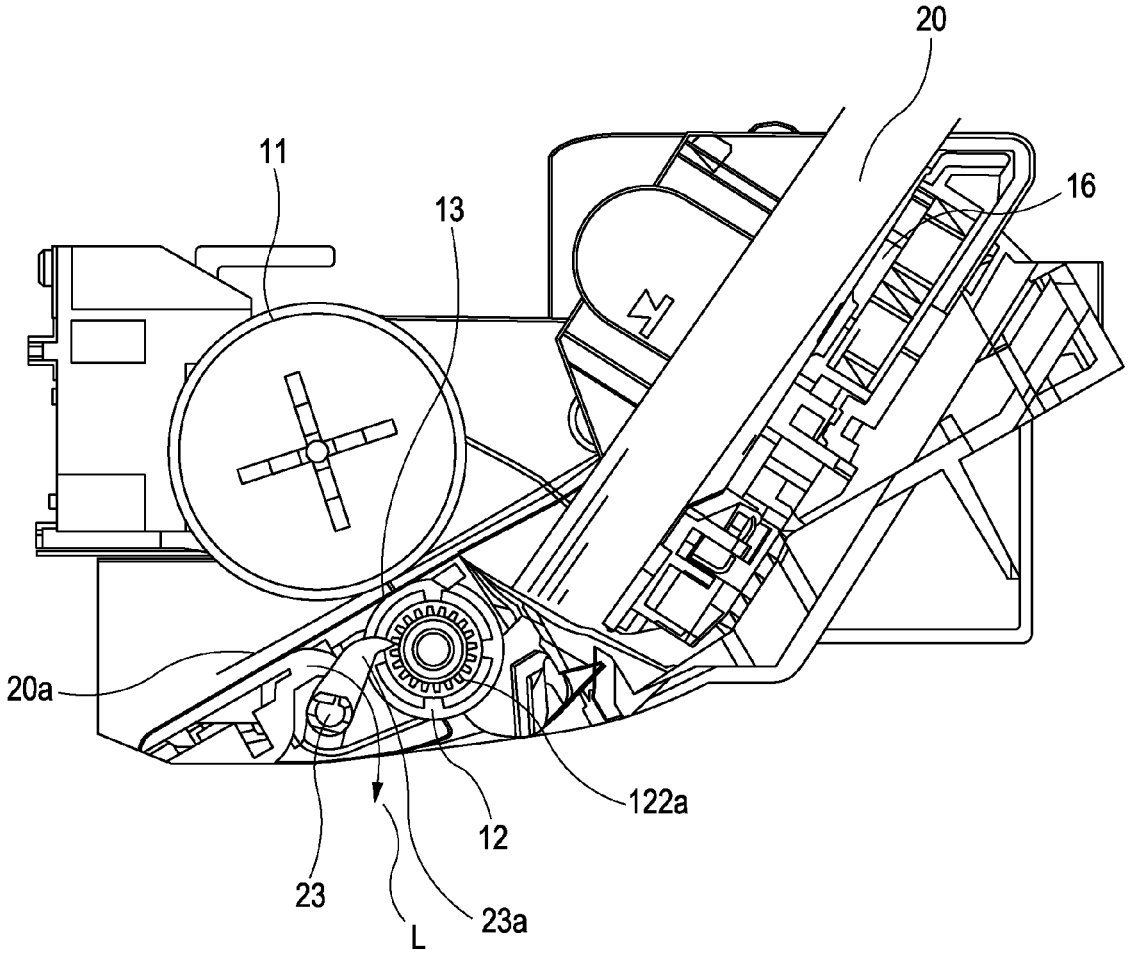
FIG. 7C is a side cross section showing the operation of the feeding device.
Figure 7D:
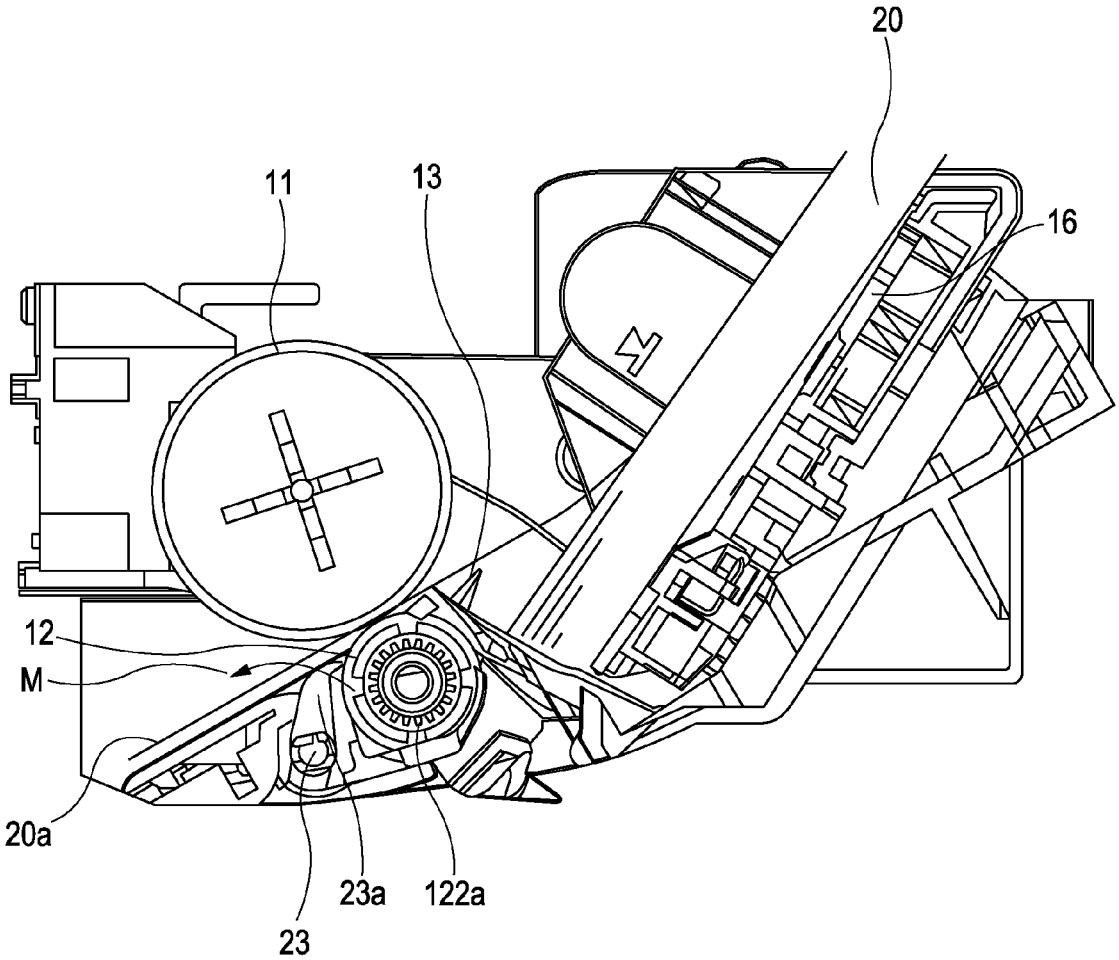
FIG. 7D is a side cross section showing the operation of the feeding device.
Figure 7E:
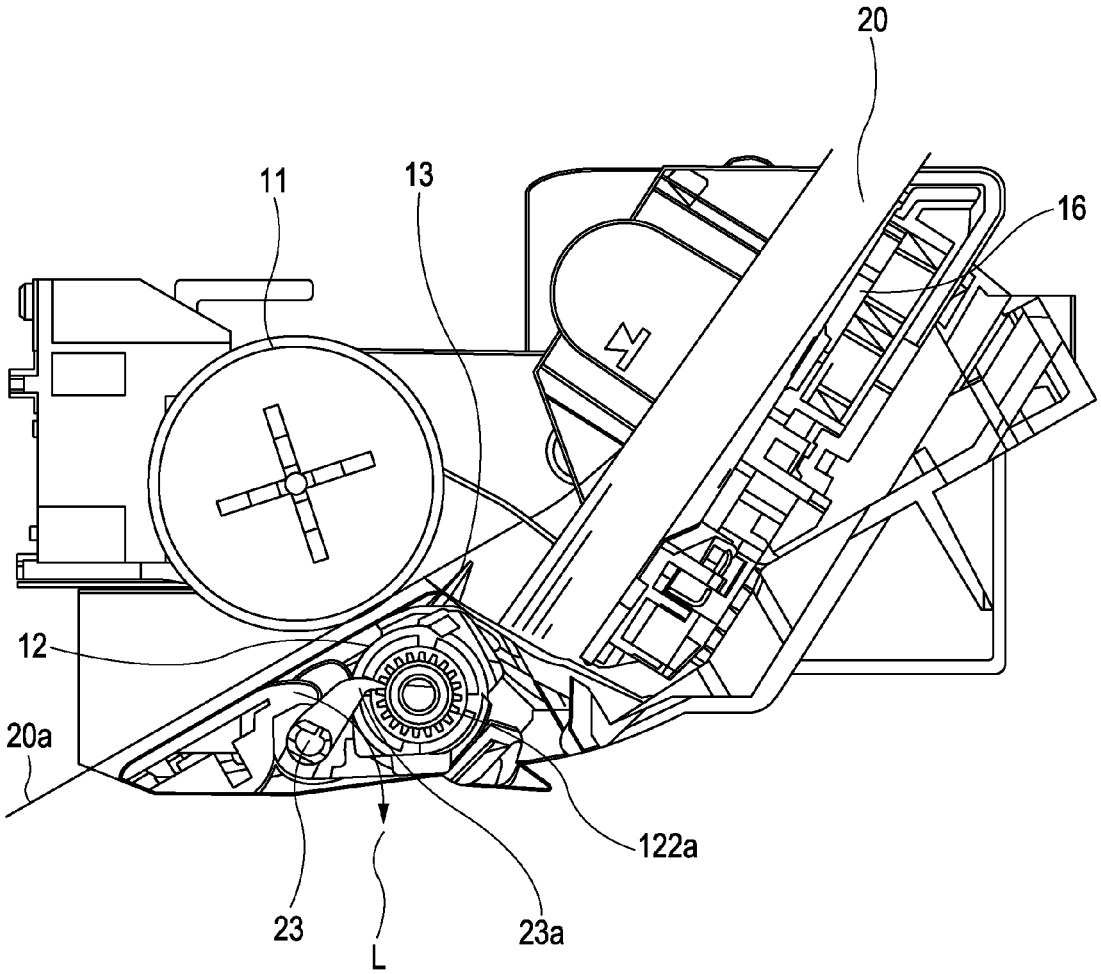
FIG. 7E is a side cross section showing the operation of the feeding device.

The lock lever 23*a* is rotatable to a position shown in FIG. 7E, and causes the separating roller 12 to be spaced apart from the feeding roller 11 against a biasing force of the separating roller spring.

The separating roller holder 21 shown in FIG. 3 is rotated around a lever shaft 23 which has the lock lever 23*a*.

The preparatory regulation portions 22*a* define a predetermined gap between the preparatory regulation portions 22*a* and the feeding roller 11 in an area located upstream of the separating portion, and regulate the number of recording sheets 20, which enter the separating portion, to be several sheets. The preparatory regulation portions 22*a* are provided at a preparatory regulation holder 22. The preparatory regulation holder 22 is attached to the base 15 (FIG. 1B) rotatably around the lever shaft 23 in a manner similar to the separating roller holder 21. The preparatory regulation holder 22 is biased with a preparatory regulation holder spring (not shown). A part of the preparatory regulation holder 22 contacts the base 15 and is positioned accordingly.

The lever shaft 23 having the lock lever 23*a* is fixed to a release cam follower 29. The separating roller 12 and the preparatory regulation holder 22 are rotatable with a control cam (not shown) via the lever shaft 23 and the release cam follower 29. The control cam is fixed coaxially with the control gear 24 shown in FIGS. 6A and 6B, and is rotationally driven with the control gear 24.

With this configuration, when the recording sheet 20 is not present between the feeding roller 11 and the separating roller 12, the separating roller 12 is idly rotated by the rotation of the feeding roller 11. In contrast, when the recording sheet 20 enters between the feeding roller 11 and the separating roller 12, the friction force between the feeding roller 11 and the separating roller 12 becomes larger than the friction force between the separating roller 12, which is idly driven with a predetermined torque, and the recording sheet 20. Accordingly, the recording sheet 20 is conveyed while the separating roller 12 is idly driven. However, when two recording sheets 20 enter between the feeding roller 11 and the separating roller 12, a friction force between the feeding roller 11 and the recording sheet 20 adjacent to the feeding roller 11 becomes larger than a friction force between the recording sheets. Also, a friction force between the recording sheet 20 adjacent to the torque limiter and the separating roller 12 becomes larger than the friction force between the recording sheets. Thus, the two recording sheets may slide relative to each other. As a result, only the recording sheet 20 adjacent to the feeding roller 11 is conveyed. The recording sheet 20 adjacent to the separating roller 12 is stopped at a position when the rotation of the separating roller 12 is stopped, and would not be conveyed.

The return lever 13 shown in FIG. 1A and other drawings is provided in addition to the separating roller 12, to prevent double feeding. As described above, when the two recording sheets 20 are fed and only the recording sheet 20 adjacent to the feeding roller 11 is conveyed, if a next recording sheet 20 is continuously fed while the previous recording sheet 20 is left near the nip, a plurality of recording sheets 20 are conveyed at the same time. That is, double feeding may occur. To prevent the double feeding, the return lever 13 is provided.

When the recording sheet 20 is set or in a standby state, the return lever 13 comes into a sheet conveying path to prevent the front edge of the recording sheet 20 from unintentionally entering into a deep portion of the feeding device 1. The return lever 13 is released after the feeding operation is started, and then, is rotated and retracted from the conveying path of the recording sheet 20. Hence, the return lever 13 does not interrupt advance of the recording sheet 20 during feeding.

After the separating operation is completed, the return lever 13 starts an operation to cause second and later recording sheets 20 located at the separation nip to return. After the returning operation of the recording sheets 20, the return lever 13 is rotated to a position that is retracted from the sheet conveying path, and after a rear edge of the recording sheet 20 is output from the feeding device 1, the return lever 13 is restored to a position in the standby state.

[Example Single-Sheet Feeding Operation]

Next, an example feeding operation is described, in which the feeding device 1 having the above configuration feeds a single recording sheet 20 to the recording portion (not shown). As mentioned above, FIGS. 7A to 7E are side cross sections showing an operation of the feeding device 1. FIG. 8 is a timing chart showing an operation of the feeding device 1. More specifically, FIG. 8 shows transmission of a driving force to the feeding roller 11, a position of the pressure plate 16, a position of the return lever 13, a position of the separating roller 12, and a state of the torque limiter of the separating roller 12. Also, the horizontal axis represents a rotation angle of the control gear 24. FIG. 10 is a flowchart showing an operation when a single recording sheet 20 is fed.

(Standby State)

An angle of 0° of the control gear 24 in FIG. 8 represents a standby state. In the standby state, referring to FIGS. 8 and 7A, the pressure plate 16 is held at a position spaced apart from the feeding roller 11 which has a circular cross section. A gap that is sufficient for stacking a plurality of recording sheets 20 is provided between the feeding roller 11 and the pressure plate 16. Also, the return lever 13 shown in FIG. 1A and other figures comes into the sheet conveying path, so as to prevent the front end of the set recording sheet 20 from falling into the separating portion. The separating roller 12 is pressed to the feeding roller 11. Thus, the torque of the separating roller 12 is ready to be generated (torque generation ready state). Referring to FIG. 7A, the torque generation ready state of the separating roller 12 is provided such that the lock lever 23*a* bites into the gear portion 122*a* provided at the end of the clutch shaft 122.

The recording sheet 20 is in the standby state while the front edge of the recording sheet 20 is supported by the sheet edge reference portion 15*a*, and the back surface of the stacked sheets is supported by the pressure plate 16. The above description is for the standby state.

(Pickup Operation)

Next, a process from the feeding start to delivery of the recording sheet 20 to the recording portion is described on the basis of a rotation angle of the control gear 24. The feeding operation of the feeding device 1 can be divided into three operations of a pickup operation, a separating operation, and a conveying operation. Also, the pickup operation includes a first pickup operation and a second pickup operation. The first pickup operation corresponds to a first feeding operation and the second pickup operation corresponds to a second feeding operation. Here, the first pickup operation is described.

Angles θ1 to θ12 of the control gear 24 in FIG. 8, and FIGS. 7B to 7C represent the separating operation. The driving force to the control gear 24 is transmitted from a drive source (not shown).

When the feeding operation is started, the rotation of the feeding roller 11 is started in a direction indicated by arrow K in FIG. 7B via the control gear 24. Then, the separating roller 12 is idly rotated by the rotation of the feeding roller 11 in a direction indicated by arrow N in the same drawing. The torque of the clutch spring 123 (FIG. 4) provided in the separating roller 12 is increased to a predetermined torque.

When the control gear 24 reaches the angle θ1 in FIG. 8, the sensor flag 24*a* (FIG. 6B) provided at the control gear 24 passes the feeding sensor 30 (FIG. 6B), and hence, it is recognized that the feeding operation is started.

When the control gear 24 is rotated to the angle θ2 in FIG. 8, the fixing of the pressure plate 16 is released by an action of the pressure plate cam 25 (FIG. 6A) provided coaxially with the control gear 24. Referring to FIG. 7B, the stacked recording sheet 20 is gradually rotated toward the feeding roller 11 by an action of the pressure plate spring 17.

When the control gear 24 is rotated to the angle θ3 in FIG. 8, the return lever 13 (FIG. 1A) is released by an action of the control cam (not shown) provided at the control gear 24, and the conveying path of the recording sheet 20 is provided.

When the feeding operation continues, and the control gear 24 is rotated to an angle in a range of from θ4 to θ4' in FIG. 8, the rotation of the pressure plate 16 continues by an action of the pressure plate cam 25 (FIG. 6A). Referring to FIG. 7B, the recording sheet 20 stacked on the pressure plate 16 is pressed to the feeding roller 11 by an action of the pressure plate spring 17. The angle θ4 indicates an angle at which a recording sheet 20 contacts the feeding roller 11 when a stacked amount of the recording sheets 20 is full, and the angle θ4' indicates an angle when the stacked amount of the recording sheets 20 is one. The angle varies in accordance with the stacked amount of the recording sheets 20. In either situation, a top recording sheet 20*a* being in contact with the feeding roller 11 is conveyed by the rotation of the feeding roller 11. That is, the first pickup operation (described later) is different from the second pickup operation in that the recording sheet 20 is pressed to the feeding roller 11 while the feeding roller 11 is being rotated.

When the plurality of recording sheets 20 are pressed to the feeding roller 11, the second and later recording sheets 20 in addition to the top recording sheet 20*a* may be fed with the friction force between the recording sheets.

(Separating Operation)

The plurality of recording sheets 20 are fed by the feeding roller 11 through the pickup operation.

It is noted that the number of the recording sheets 20 to pass is regulated to several sheets including the top recording sheet 20*a* by an action of the gap defined between the preparatory regulation portions 22*a* in FIG. 3 and the feeding roller 11 in FIG. 7B and other figures.

When the feeding operation further continues, the plurality of recording sheets 20 reach the separating portion defined by the nip between the feeding roller 11 and the separating roller 12. When the recording sheets 20 are advanced, a force acts so as to rotate the separating roller 12 in the direction indicated by arrow N in FIG. 7B. However, as shown in the same drawing, the lock lever 23*a* bites into the gear portion 122*a* of the clutch shaft 122. When the separating roller 12 is to be rotated in the direction indicated by arrow N in this state, the clutch cylinder 121 (FIG. 5) is rotated, however, the rotation of the clutch shaft 122 is inhibited by the lock lever 23*a*. Accordingly, a torque necessary for separation is generated by an action of the clutch spring 123. Thus, only the top recording sheet 20*a* is separated from the residual recording sheets 20.

When the control gear 24 is rotated to an angle in a range of from θ6 to θ6' in FIG. 8, a spacing operation of the pressure plate 16 is started. The angle θ6 indicates an angle at which the spacing operation of the pressure plate 16 is started when a stacked amount of the recording sheets 20 is full, and the angle θ6' indicates an angle when the stacked amount of the recording sheets 20 is one. The angle varies in accordance with the stacked amount of the recording sheets 20 similarly to the angles θ4 and θ4'.

When the control gear 24 is rotated to the angle θ7 in FIG. 8, the rotation of the return lever 13 shown in FIG. 7C and other figures is started toward a position for preventing the double feeding.

When the control gear 24 is rotated to the angle θ8 in FIG. 8, the lever shaft 23 is rotated in a direction indicated by arrow L in FIG. 7C via the release cam follower 29 (FIG. 3) by an action of the control cam. Then, the lock lever 23*a* of the lever shaft 23 allows the gear portion 122*a* of the clutch shaft 122 to be rotated in the direction indicated by arrow L. Hence, the separating roller 12 starts to be spaced apart from the feeding roller 11.

Also, a part (not shown) of the lever shaft 23 contacts the preparatory regulation holder 22 (FIG. 3) substantially at the same time, to cause the preparatory regulation holder 22 to be rotated in the direction indicated by arrow L in FIG. 7C.

Meanwhile, the front end of the return lever 13 presses the second and later recording sheets 20, which have passed the nip between the feeding roller 11 and the separating roller 12 and located at the separation nip, to return to the sheet stacking portion by an action of the control cam.

The feeding operation continues, and the pressure plate 16 is completely spaced apart from the feeding roller 11 while the control gear 24 is rotated to the angle θ9 in FIG. 8. The control gear 24 returns to a position which is substantially the same as the position in the standby state. The returning operation of the recording sheets 20 is also substantially completed. The lever shaft 23 is rotated in a direction indicated by arrow M in FIG. 7D via the release cam follower 29 (FIG. 3) by an action of the control cam. Thus, the preparatory regulation holder 22 (FIG. 3) released with the lever shaft 23, and the separating roller 12 are rotated in the direction indicated by arrow M, and return to the positions before the releasing.

When the returning operation of the recording sheets 20 is completed, the return lever 13 is moved not to the original standby position, but to a retracted position which is further rotated as shown in FIG. 7D. Since the return lever 13 is moved to the retracted position, the return lever 13 can be prevented from contacting the recording sheet 20*a* during conveyance, and from applying an unintentional resistance thereto. Thus, a good recording result can be obtained. The above description is for the separating operation.

(Conveying Operation)

Next, a conveying operation is described. When the control gear 24 shown in FIGS. 6A and 6B is rotated to the angle θ10 in FIG. 8, the lever shaft 23 is rotated in the direction indicated by arrow M in FIG. 7D via the release cam follower 29 (FIG. 3) by an action of the control cam. Accordingly, the lock lever 23*a* biting into the gear portion 122*a* of the clutch shaft 122 is released from the gear portion 122*a*, and the clutch shaft 122 becomes freely rotatable.

While the clutch shaft 122 is freely rotatable, a force to release the clutch spring 123 (FIG. 5) is not provided even when the separating roller 12 and the clutch cylinder 121 (FIG. 5) are rotated. Hence, the function of the torque limiter is lost. Accordingly, the separating roller 12 becomes an idle roller which is rotated without a torque by the rotation of the feeding roller 11.

When the rotation angle of the control gear 24 is located between the angle θ9 and θ12 in FIG. 8, the recording sheet 20*a* reaches the PE sensor 205 (FIG. 9B), and the recording apparatus detects conveyance of the recording sheet 20*a* (step S03 in FIG. 10). At this time, the recording apparatus records an operation time of the drive source from when the sensor flag 24*a* (FIG. 6B) of the control gear 24 passes the feeding sensor 30 (FIG. 6B) to when the PE sensor 205 (FIG. 9B) detects the recording sheet 20*a*, as a drive time (drive amount Q) of the feeding roller 11. Here, it is judged whether the drive amount Q exceeds a first threshold value Q1 or not. If "Q<Q1", a skew correction operation (step S07 in FIG. 10) is performed.

If "Q>Q1" (step S05 in FIG. 10), the process shifts to a relief sequence (step S06 in FIG. 10) which will be described later. The relief sequence corresponds to a third feeding operation.

When the control gear 24 is rotated to the angle θ12 in FIG. 8, the lever shaft 23 is rotated in the direction indicated by arrow L in FIG. 7E via the release cam follower 29 (FIG. 3) by an action of the control cam. Accordingly, the lock lever 23*a* of the lever shaft 23 reaches the gear portion 122*a* of the clutch shaft 122, and meshes with the gear portion 122*a*.

When the lock lever 23*a* of the lever shaft 23 is continuously rotated, the separating roller 12 starts to be spaced away from the feeding roller 11.

Further, when the control gear 24 is rotated to the angle θ13 in FIG. 8 (step S08 in FIG. 10), a toothless section (not shown) provided in a gear portion of the control gear 24 comes to a position facing the feeding shaft gear 19 (FIG. 1A). Accordingly, the transmission of the driving force to the feeding shaft gear 19 is interrupted. At this time, the feeding roller 11 becomes an idle roller which is rotated freely. Also, at this time, a driving switch unit (not shown) interrupts the transmission of the driving force which is applied from the drive source to the control gear 24. The mechanisms such as the return lever 13 and the pressure plate 16 are held in positions at the angle θ13 in FIG. 8 as shown in FIG. 7E.

Then, the conveying roller 221 (FIG. 9A) conveys the fed recording sheet 20*a* to a writing-start position (step S09 in FIG. 10), and the feeding operation is terminated.

When the sheet detection with the PE sensor 205 (FIG. 9B) exceeds the angle θ11 in FIG. 8 and the drive amount Q exceeds the first threshold value Q1 because of, for example, a slip between the feeding roller 11 and the recording sheet 20*a*, a sheet detection delay is recognized, and the process shifts to the relief sequence (step S06 in FIG. 10).

When the rotation angle of the control gear 24 reaches the angle θ13 while the recording sheet 20*a* is not detected, a retry sequence is performed (step S04 in FIG. 10) in which the same feeding operation is performed again. The retry sequence corresponds to a fourth feeding operation. That is, the feeding device 1 according to this embodiment can perform two or more feeding operations from among the first to fourth feeding operations.

(Operation after Feeding)

The position at the angle θ13 in FIG. 8, after the feeding operation is completed, is a recording position for the recording operation. At this time, since the feeding roller 11 functions as an idle roller, the feeding roller 11 is rotated in accordance with the advance of the recording sheet 20*a* during recording on the recording sheet 20*a*, and the feeding roller 11 is not driven with a drive gear train. Thus, feeding roller 11 does not apply an unintentional resistance to the recording sheet 20*a* during recording.

After a sheet output operation, the driving force is started to be transmitted to the control gear 24 (FIG. 6B) from the drive source (not shown) via the driving switch unit (not shown), and the control gear 24 is rotated to the angle of 0° in FIG. 8. At this time, the return lever 13 comes into the sheet conveying path again, to prevent the front edge of the recording sheet 20 from falling into the separating portion. Also, the lever shaft 23 is rotated in the direction indicated by arrow M in FIG. 7D via the release cam follower 29 (FIG. 3), so that the separating roller 12 is pressed to the feeding roller 11 while the lock lever 23*a* bites into the gear portion 122*a* of the clutch shaft 122. Accordingly, all the mechanisms return to the standby positions in the initial state. The above description is for the operation when the single recording sheet is fed in the recording apparatus to which the feeding device 1 according to the embodiment is applied.

[Example Relief Sequence]

Next, an example relief sequence is described in detail. The relief sequence is performed when the drive amount Q exceeds the first threshold value Q1. In particular, when the sheet detection with the PE sensor 205 in FIG. 9B exceeds the position at the angle θ11 in FIG. 8, the recording sheet 20*a* may not reach the conveying portion 202 (FIG. 9A) while the control gear 24 is rotated to the angle θ13. In such a case, the process shifts to the relief sequence.

FIG. 11 is a flowchart of the relief sequence.

The position of the recording sheet 20*a* is not certain when the process shifts to the relief sequence. Hence, it is not certain whether the recording sheet 20*a* has reached the conveying portion 202 (FIG. 9A) or not.

First, the feeding roller 11 (FIG. 9B) and the conveying roller 221 (FIG. 9A) are rotated at the same time in the same direction, and the feeding device 1 is driven to the recording position at the angle θ13 in FIG. 8. The conveying roller 221 is driven such that a conveyance amount with the conveying roller 221 becomes larger than at least a conveyance amount with the feeding roller 11 (step S101 in FIG. 11). At this time, the recording sheet 20*a* is likely pinched by the conveying roller 221.

Since the feeding device 1 is located at the recording position, the recording sheet 20*a* is free from the feeding device 1. In this state, the conveying roller 221 is rotated reversely, so that the recording sheet 20*a* which is likely pinched by the conveying roller 221 returns to the nip position of the conveying roller 221 (step S102 in FIG. 11).

Then, only the feeding roller 11 is driven by a predetermined amount, to cause the recording sheet 20*a* to contact the nip of the conveying roller 221 (step S103 in FIG. 11). Further, a predetermined skew correction operation is performed in accordance with the type of the recording sheet 20*a* (step S104 in FIG. 11), so that the feeding device 1 shifts to the recording position which is the position at the angle θ13 in FIG. 8 (step S105 in FIG. 11). Then, the recording sheet 20*a* is conveyed to the writing-start position (step S106 in FIG. 11), and the feeding operation is terminated (step S107 in FIG. 11). The above description is for the operation of the relief sequence.

[Example Continuous Feeding Operation]

Next, a continuous feeding operation is described, in which recording sheets are continuously fed from the feeding device 1 to the recording apparatus body (not shown).

For example, when recording data for multiple pages is to be recorded on recording sheets, or when multiple copies of recording data are to be made, such recording data is collectively transferred to the recording apparatus body. At this time, the feeding device 1 continuously feed sheets of the same type so that the recording apparatus body can continuously perform a recording operation. During the continuous feeding operation, the shift from the recording position to the standby position may be omitted, and the recording operation may be started directly from the recording position.

Figure 12B:
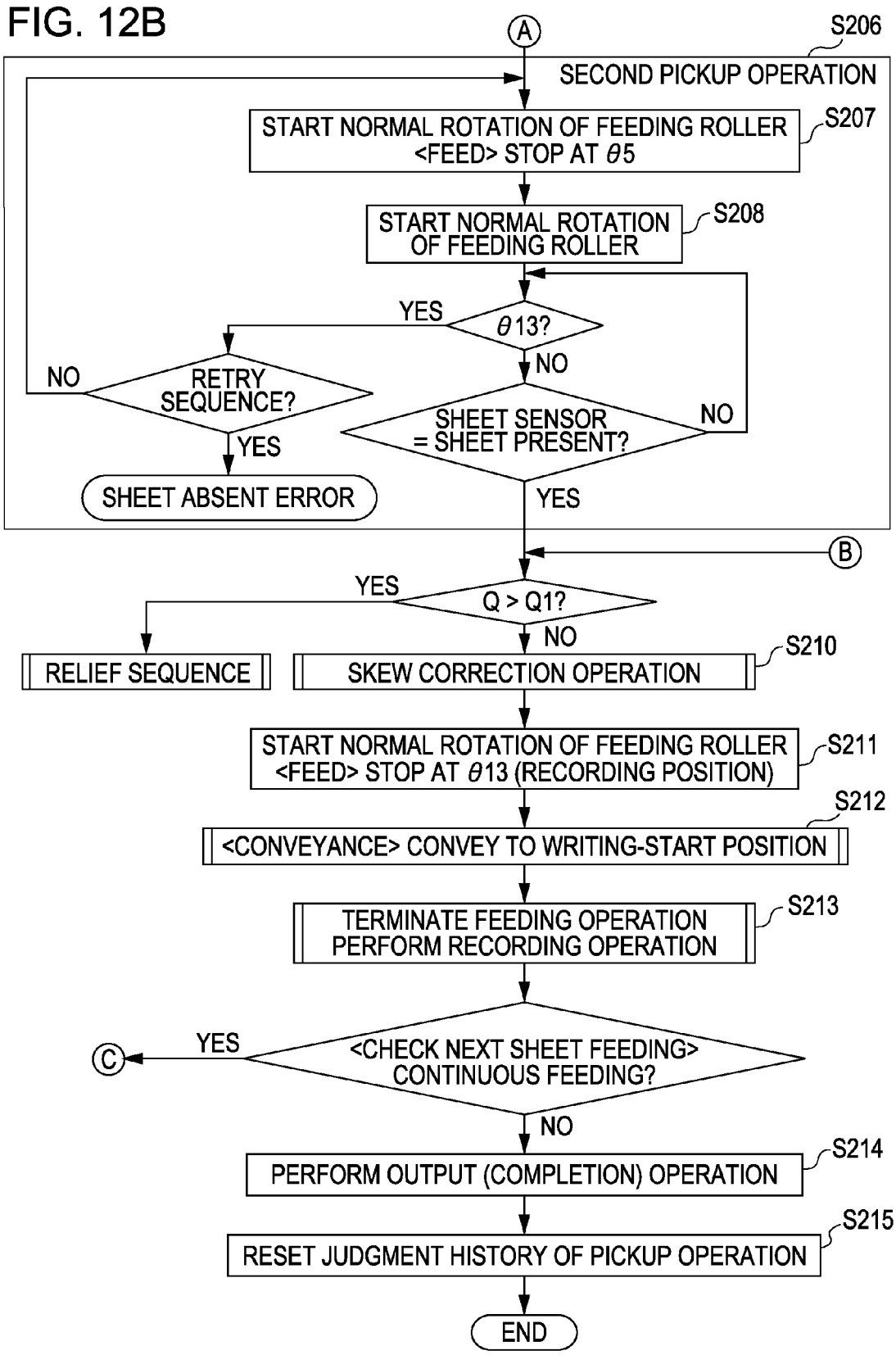

FIGS. 12A and 12B show a flowchart of the continuous feeding operation. For the continuous feeding operation, the feeding operation is performed in association with the output operation of a previous recording sheet 20.

To perform continuous feeding, a previous feeding operation is checked before a feeding operation is performed. In particular, during an output (continuous feeding) operation (step S201 in FIG. 12A), the previous feeding operation is checked when a rear edge of the previous recording sheet 20 passes the PE sensor 205 (FIG. 9B). More specifically, it is checked whether the relief sequence or the retry sequence has been performed in the previous feeding operation (step S202 in FIG. 12A). Also, it is checked whether the previous feeding operation is the second pickup operation (described later) or not (step S203 in FIG. 12A). If any of the relief sequence, the retry sequence, and the second pickup operation has been performed in the previous feeding operation, a next feeding operation is switched to the second pickup operation (described later) (step S206 in FIG. 12B). That is, when the previous feeding operation is a feeding operation other than the first feeding operation, the second feeding operation is performed as the next feeding operation.

Also, it is judged whether the drive amount Q in the previous feeding operation, from when the sensor flag 24*a* (FIG. 6B) of the control gear 24 passes the feeding sensor 30 (FIG. 6B) to when the PE sensor 205 detects the recording sheet, exceeds a second threshold value Q2 or not (step S204 in FIG. 12A). Even if "Q>Q2", the second pickup operation is performed (step S206 in FIG. 12B). The second threshold value Q2 is smaller than the first threshold value Q1 which serves as a reference for the shift to the relief sequence. For example, the second threshold value Q2 is set such that Q2=0.95×Q1.

In the judgment of the pickup operation (steps S202 to S204 in FIG. 12A), if the second pickup operation is judged not to be performed, the normal first pickup operation is performed (step S205 in FIG. 12A).

In any of the first and second pickup operations, measurement of the drive amount Q is started when the sensor flag 24*a* of the control gear 24 passes the feeding sensor 30.

When the recording sheet 20 reaches the PE sensor 205 in the pickup operation, the drive amount Q is determined. At this time, when the sheet detection delay is recognized as described above, the process shifts to the relief sequence. When the angle reaches the angle θ13 in FIG. 8 although the recording sheet is not still detected, the process goes to the retry sequence.

When the recording sheet 20 reaches the PE sensor 205 normally, a predetermined skew correction operation is performed in accordance with the type of the recording sheet 20 (step S210 in FIG. 12B), so that the feeding device 1 shifts to the recording position which is the position at the angle θ13 in FIG. 8 (step S211 in FIG. 12B). Then, the recording sheet 20 is conveyed to the writing-start position (step S212 in FIG. 12B), and the feeding operation is terminated (step S213 in FIG. 12B).

The feeding device 1 waits at the recording position for completion of the recording operation with the recording apparatus body. After the recording operation is completed, a next recording operation is performed. The feeding device 1 that continuously performs the continuous feeding operation returns to the output (continuous feeding) operation (step S201 in FIG. 12A), and performs a next feeding operation.

If a next recording operation is not present, an output (completion) operation is performed (step S214 in FIG. 12B). After the operation is completed, the presence of the relief sequence, the presence of the retry sequence, and the performance of the second pickup operation, which are pickup-operation judgment items, are reset (step S215 in FIG. 12B). The above description is for the continuous feeding operation.

[Second Pickup Operation]

Next, the second pickup operation (step S206 in FIG. 12B) is described with reference to FIG. 12B. The second pickup operation is arranged as a part of the continuous feeding operation.

Since the sheet detection with the PE sensor 205 is likely delayed because of, for example, a slip between the feeding roller 11 and the recording sheet 20, the second pickup operation is provided to reduce a slip between the feeding roller 11 and the recording sheet 20.

After the feeding operation of the feeding device 1 is started, the fixing of the pressure plate 16 is released by an action of the pressure plate cam 25, and the pressure plate 16 is rotated. As shown in FIG. 7B, the stacked recording sheet 20 is pressed to the feeding roller 11 by an action of the pressure plate spring 17. Regardless of the stacked amount of the recording sheets 20, when the rotation angle of the control gear 24 reaches the angle θ5, at which the feeding roller 11 reliably contacts the top recording sheet 20*a*, the drive source (not shown) is temporarily stopped, and the rotation of the feeding roller 11 is also stopped (step S207 in FIG. 12B). Hence, when the recording sheets 20 stacked on the pressure plate 16 are pressed to the feeding roller 11, the feeding roller 11 is being stopped. Accordingly, an amplitude of a vibration that is generated at the pressure plate 16 (recording sheets 20) during pressing can be reduced, as compared with the case where the recording sheets 20 are pressed to the feeding roller 11 while the feeding roller 11 is being rotated. The amplitude of the vibration relates to the stacked amount of the recording sheets 20. If the stacked amount decreases, the amplitude increases.

After the temporary stop, the drive source (not shown) is reactivated, and the rotation of the feeding roller 11 is restarted (step S208 in FIG. 12B). In other words, the rotation of the feeding roller 11 is restarted after the vibration generated at the pressure plate 16 (recording sheets 20) during pressing is stopped. At this time, the feeding roller 11 and the recording sheet 20*a* are reliably in contact with each other, and hence, a static friction force is generated between the feeding roller 11 and the recording sheet 20*a*. The conveying force of the feeding roller 11 is thus increased. Accordingly, a slip hardly occurs between the feeding roller 11 and the recording sheet 20*a*. Thus, the second pickup operation is different from the first pickup operation in that the recording sheets 20 are pressed while the rotation of the feeding roller 11 is temporarily stopped.

As described above, the inkjet recording apparatus provided with the feeding device 1 according to this embodiment includes the PE sensor 205 that detects the recording sheet 20 in an area located downstream of the feeding device 1, and the drive source (not shown) that drives the feeding device 1. Immediately after the feeding operation is started, the drive amount Q of the drive source, from the sensor flag 24*a* of the control gear 24 passes the feeding sensor 30 to when the PE sensor 205 detects the recording sheet, is measured. When the drive amount Q exceeds the predetermined threshold value Q2, the pickup operation of the feeding device 1 is changed.

Also, in the continuous feeding operation, when the drive amount Q exceeds the predetermined threshold value Q2, and the relief sequence or the retry sequence has been performed, the pickup operation in the next feeding operation is changed from the first pickup operation to the second pickup operation.

In addition, during the continuous feeding operation, the feeding operation is performed with the second pickup operation. When the continuous feeding operation is completed, and the feeding device 1 becomes the standby state, the feeding control is reset, and the pickup operation returns to the first pickup operation.

With the above configuration, the recording sheet can be prevented from being damaged by the relief sequence or the retry sequence, without seriously increasing a cost and a feeding time, or without decreasing a throughput during normal feeding.

Second Exemplary Embodiment

In the first embodiment, the configuration is described in which the second pickup operation is reset when the continuous feeding operation is completed, and returns to the first pickup operation.

Next, an embodiment other than the first embodiment is briefly described.

A third threshold value is set, which relates to a drive amount Q from when the sensor flag 24*a* of the control gear 24 in FIG. 6B passes the feeding sensor 30 to when the PE sensor 205 in FIG. 9B detects a recording sheet. In particular, a third threshold value Q3 that is equal to or smaller than Q2 is set in addition to the first threshold value Q1 which is the reference for the shift to the relief sequence, and the second threshold value Q2 which is the reference for the shift to the second pickup operation. In a feeding operation as the second pickup operation performed in the continuous feeding operation, when the drive amount Q is the third threshold value Q3 or smaller, or when "Q≤Q3", the pickup operation in the previous feeding operation returns to the first pickup operation.

At this time, when the pickup operation has been changed to the second pickup operation because of an accidental feeding failure, the pickup operation can return to the first pickup operation before the continuous feeding operation is completed.

In addition, a plurality of pickup operations, such as a third pickup operation and a fourth pickup operation, are set to respectively have different temporary stop times, which are incremented stepwise, in the position at the angle θ5 in FIG. 8. A threshold value to change the pickup operation from the second pickup operation to third pickup operation is set larger than the threshold value Q2 to change the pickup operation from the first pickup operation to second pickup operation. Further, a threshold value to change the pickup operation to the fourth or later pickup operation is set further larger.

In this case, an efficient pickup operation can be provided, in which activation the relief sequence or the retry sequence is restricted, merely by a minimum extension of the feeding time, in accordance with the vibration stop time during pressing with the pressure plate, or a slip amount due to paper dust.

If the second pickup operation is necessary for a special recording sheet which, for example, causes a large amount of paper dust to be generated, a feeding instruction with sheet information added may be used. When the sheet type is changed, the pickup operation may return to the first pickup operation. Or, the second pickup operation may be originally applied.

The second pickup operation may be performed only when an integral value of the drive amount Q exceeds a threshold value, or when the drive amount Q exceeds the threshold value continuously for a plurality of times.

With any of the embodiments of the present invention, the feeding device and the recording apparatus can be provided, with which the cost and the feeding time are not increased, and the recording sheet can be prevented from being damaged by the operation such as the retry feeding.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

What is claimed is:

1. A feeding device comprising:

a stacking unit configured to stack a plurality of recording sheets;

a feeding unit configured to feed the recording sheets stacked on the stacking unit;

a separating unit configured to separate a recording sheet from the recording sheets stacked on the stacking unit;

a detecting unit configured to detect the recording sheet in an area located downstream of the separating unit in a feeding direction of the recording sheet; and a control unit configured to selectively perform one of at least two feeding operations in accordance with a drive time of the feeding unit from when the feeding unit is started to be driven to when the detecting unit detects the recording sheet in a previous feeding operation of a previous sheet, the at least two feeding operations including a first feeding operation in which the recording sheet contacts the feeding unit to be fed while the feeding unit is being driven, and a second feeding operation in which a rotation of the feeding unit is stopped temporarily after the recording sheet contacts the feeding unit, and then the feeding unit is driven again.

2. The feeding device according to claim 1, wherein the at least two feeding operations include a third feeding operation in which a time from when the driving of the feeding unit is stopped to when the driving of the feeding unit is started again is longer than that of the second feeding operation, and a fourth feeding operation in which a time from when the driving of the feeding unit is stopped to when the driving of the feeding unit is started again is longer than that of the third feeding operation.

3. The feeding device according to claim 1, wherein the control unit switches the feeding operation to other feeding operation when the drive time exceeds a first threshold value.

4. The feeding device according to claim 3, wherein the control unit switches a next feeding operation to the second feeding operation when a drive time in a previous feeding operation exceeds a second threshold value.

5. The feeding device according to claim 4, wherein the second threshold value is smaller than the first threshold value.

6. The feeding device according to claim 4, wherein the control unit switches the next feeding operation to the second feeding operation when the drive time in the first feeding operation exceeds the second threshold value, and switches the next feeding operation to the first feeding operation when the drive time in the switched second feeding operation is a third threshold value or smaller.

7. The feeding device according to claim 4, wherein the control unit switches the next feeding operation to the second feeding operation when the plurality of recording sheets are continuously fed in the first feeding operation and the drive time of the first feeding operation exceeds the second threshold value, then allows the second feeding operation to be continuously performed, and after the continuous feeding is completed, switches the second feeding operation to the first feeding operation.

8. The feeding device according to claim 1, wherein the control unit switches the feeding operation to other feeding operation when an integral value of the drive time exceeds a first threshold value, or when the drive time continuously exceeds the first threshold value.

9. The feeding operation according to claim 1, wherein the control unit checks a previously performed feeding operation before a feeding operation is performed, and if the previously performed feeding operation is the feeding operation other than the first feeding operation, the control unit performs the second feeding operation.

10. The feeding device according to claim 1, wherein the feeding unit is a rotational body that is rotationally driven while being in contact with the recording sheet.

11. The feeding device according to claim 1, wherein the stacking unit is a pressure plate that is rotatable in directions toward and away from the feeding unit.

12. The feeding device according to claim 1, further comprising a drive unit configured to drive the feeding unit, wherein the control unit recognizes an operation time of the drive unit as the drive time.

13. The feeding device according to claim 1, wherein, in the second feeding operation, the recording sheet contacts the feeding unit to be fed while the feeding unit is being driven, then the driving of the feeding unit is stopped while the recording sheet contacts the feeding unit, and then the feeding unit is driven again while the recording sheet contacts the feeding unit.

14. A recording device comprising:

a stacking unit configured to stack a plurality of recording sheets;

a feeding unit configured to feed the recording sheets stacked on the stacking unit;

a separating unit configured to separate a recording sheet from the recording sheets stacked on the stacking unit;

a detecting unit configured to detect the recording sheet in an area located downstream of the separating unit in a feeding direction of the recording sheet;

a control unit configured to selectively perform one of at least two feeding operations in accordance with a drive time of the feeding unit from when the feeding unit is started to be driven to when the detecting unit detects the recording sheet in a previous feeding operation of a previous sheet, the at least two feeding operations including a first feeding operation in which the recording sheet contacts the feeding unit to be fed while the feeding unit is being driven, and a second feeding operation in which a rotation of the feeding unit is stopped temporarily after the recording sheet contacts the feeding unit, and then the feeding unit is driven again; and a recording unit configured to perform recording on the recording sheet to be fed, in accordance with input recording data.

15. A feeding device comprising:

a stacking unit configured to stack a plurality of sheets;

a feeding unit configured to feed the sheets stacked on the stacking unit in a feeding direction, wherein the feeding unit selectively performs a first feeding operation in which a sheet contacts the feeding unit to be fed while the feeding unit is being driven, or a second feeding operation in which rotation of the feeding unit is stopped temporarily after the sheet contacts the feeding unit;

a separating unit configured to separate a sheet from the sheets stacked on the stacking unit; and a control unit configured to control the feeding unit such that, in a case where the feeding unit performed the first feeding operation and a timing when a sheet arrived at a predetermined position located downstream of the separating unit in the feeding direction was delayed from a predetermined timing, the feeding unit performs the second feeding operation in a next feeding operation to feed a next sheet.

16. The feeding device according to claim 15, wherein the control unit controls the feeding unit such that, in a case where the feeding unit performed the second feeding operation, the feeding unit performs the second feeding operation in a next feeding operation.

17. The feeding device according to claim 15, wherein the control unit controls the feeding unit such that, in a case where the feeding unit performed the second feeding operation and a timing when a sheet arrived at a predetermined position is earlier than the predetermined timing by a first period, the feeding unit performs the first feeding operation in a next feeding operation.

18. The feeding device according to claim 15, wherein the control unit controls the feeding unit such that, in a case where the feeding unit performed the first feeding operation and a timing when a sheet arrived at the predetermined position was delayed from the predetermined timing as a first predetermined timing, the feeding unit performs the second feeding operation in which the rotation of the feeding unit is stopped temporarily by a second period in a next feeding operation, and in a case where the feeding unit performed the first feeding operation and a timing when a sheet arrived at the predetermined position was delayed from a second predetermined timing that is later than the first predetermined timing, the feeding unit performs a third feeding operation in which the rotation of the feeding unit is stopped temporarily by a third period that is longer than the second period in a next feeding operation.

19. A recording device comprising:

a stacking unit configured to stack a plurality of sheets;

a feeding unit configured to feed the sheets stacked on the stacking unit in a feeding direction, wherein the feeding unit selectively performs a first feeding operation in which a sheet contacts the feeding unit to be fed while the feeding unit is being driven, or a second feeding operation in which rotation of the feeding unit is stopped temporarily after the sheet contacts the feeding unit;

a separating unit configured to separate a sheet from the sheets stacked on the stacking unit;

a recording unit configured to perform recording on the sheet fed by the feeding unit, in accordance with input recording data; and a control unit configured to control the feeding unit such that, in a case where the feeding unit performed the first feeding operation and a timing when a sheet arrived at a predetermined position located downstream of the separating unit in the feeding direction was delayed from a predetermined timing, the feeding unit performs the second feeding operation in a next feeding operation to feed a next sheet.

20. The feeding device according to claim 19, wherein the control unit controls the feeding unit such that, in a case where the feeding unit performed the second feeding operation, the feeding unit performs the second feeding operation in a next feeding operation.

* * * * *